US011728601B2

(12) United States Patent
Lybik et al.

(10) Patent No.: US 11,728,601 B2
(45) Date of Patent: Aug. 15, 2023

(54) MODULAR POWER SOURCE

(71) Applicant: ReVert Technologies, Inc., Lewes, DE (US)

(72) Inventors: Joseph E. Lybik, Detroit, MI (US); Yuan Ryan Li, Jersey City, NJ (US); David Gregerson, Lawrenceville, GA (US); Amir Tayyebi Moghaddam, Atlanta, GA (US); Erwin Noble, Alpharetta, GA (US)

(73) Assignee: ReVert Technologies, Inc., Lewes, DE (US)

( * ) Notice: Subject to any disclaimer, the term of this patent is extended or adjusted under 35 U.S.C. 154(b) by 9 days.

(21) Appl. No.: 17/411,759

(22) Filed: Aug. 25, 2021

(65) Prior Publication Data

US 2022/0140554 A1 May 5, 2022

Related U.S. Application Data

(60) Provisional application No. 63/109,987, filed on Nov. 5, 2020.

(51) Int. Cl.
*H01R 31/06* (2006.01)
*H01R 35/04* (2006.01)
(Continued)

(52) U.S. Cl.
CPC ..... *H01R 31/065* (2013.01); *H01R 13/514* (2013.01); *H01R 13/6205* (2013.01);
(Continued)

(58) Field of Classification Search
CPC ..... H01R 31/065; H01R 13/514; H01R 13/6205; H01R 13/6675; H01R 13/6683
(Continued)

(56) References Cited

U.S. PATENT DOCUMENTS 6,156,971 A * 12/2000 May ..... H02G 3/00 174/59
6,157,350 A * 12/2000 House ..... H01Q 1/084 343/702
(Continued)

FOREIGN PATENT DOCUMENTS

AU 2010201810 7/2011
KR 20150089861 8/2015

OTHER PUBLICATIONS

Cyberpower GT600P Product Information—"https://www.cyberpowersystems.com/product/general-power/adapters-taps/gt600p/", Retrieved Oct. 1, 2020, 2 pages.
(Continued)

*Primary Examiner* — Alexander Gilman
(74) *Attorney, Agent, or Firm* — Riverside Law LLP

(57) ABSTRACT

A modular power source comprises a middle block having a housing, comprising a connector for receiving power from a supply of electricity, and at least one electrical socket on a face of the middle block, at least one wing assembly, comprising at least one connector on a face of the wing assembly, the connector configured to form an electrical connection between the wing assembly and the inner block, and at least one controllable electrical socket, and at least one computing device configured to connect or disconnect the at least one controllable electrical socket from the power source, wherein the at least one wing assembly is configured to rotate about an axis with respect to the middle block when electrically connected to the middle block via the electrical connection. Alternative embodiments are also disclosed.

20 Claims, 21 Drawing Sheets

(51) Int. Cl.
*H01R 13/514* (2006.01)
*H01R 13/62* (2006.01)
*H01R 13/66* (2006.01)

(52) U.S. Cl.
CPC ..... *H01R 13/6675* (2013.01); *H01R 13/6683* (2013.01); *H01R 13/6691* (2013.01); *H01R 35/04* (2013.01)

(58) Field of Classification Search
USPC ..... 439/39
See application file for complete search history.

(56) References Cited

U.S. PATENT DOCUMENTS 6,780,038 B1 * 8/2004 Huang ..... H01R 13/113 439/640
7,371,122 B2 * 5/2008 Ivanova ..... H01R 25/003 439/652
7,484,689 B2 * 2/2009 Musial ..... B64F 1/34 244/114 R
7,500,854 B2 * 3/2009 Gottstein ..... H01R 25/006 439/21
7,972,152 B1 * 7/2011 Wu ..... H01R 25/00 439/131
8,007,295 B2 * 8/2011 Lin ..... H01R 25/006 439/131
8,221,131 B1 * 7/2012 Mazyek ..... H01R 9/2408 439/13
8,702,437 B2 * 4/2014 Fullerton ..... H01R 13/6675 439/236
8,926,346 B2 * 1/2015 Hsu ..... H01R 13/6675 439/224
9,124,056 B1 * 9/2015 Lewis, Jr. ..... H02G 3/185
9,484,692 B2 11/2016 Irons
9,735,492 B2 * 8/2017 Shum ..... H01R 35/04
9,748,709 B2 * 8/2017 Byrne ..... H01R 13/746
10,320,137 B2 * 6/2019 Almouli ..... H01R 39/64
10,608,395 B1 * 3/2020 Chen ..... H01R 13/506
10,763,631 B2 * 9/2020 Liu ..... H01R 35/04
11,095,080 B1 * 8/2021 Chen ..... H01R 27/02
11,374,351 B2 * 6/2022 Storione ..... H01R 12/714
2001/0018277 A1 * 8/2001 Gerard ..... H01R 35/04 439/13
2003/0134537 A1 * 7/2003 Pedulla ..... H01R 25/003 439/535
2003/0236010 A1 * 12/2003 Gorman ..... H01R 13/44 439/107
2005/0148241 A1 * 7/2005 Kohen ..... F21V 23/06 439/441
2006/0110977 A1 * 5/2006 Matthews ..... H01R 9/0524 439/578
2007/0014068 A1 * 1/2007 Huang ..... H01H 83/04 361/115
2007/0086127 A1 * 4/2007 Huang ..... H02H 3/335 361/42
2008/0227333 A1 * 9/2008 Hazani ..... H04B 3/542 439/578
2011/0021049 A1 * 1/2011 Ramasubramanian ..... H01R 13/521 439/271
2011/0298301 A1 * 12/2011 Wong ..... G01D 4/004 702/62
2015/0340805 A1 * 11/2015 Jordan ..... H01R 13/622 439/338
2018/0323556 A1 * 11/2018 Storione ..... H01R 13/5219
2019/0363498 A1 * 11/2019 Cox ..... B25J 19/0029
2020/0076113 A1 * 3/2020 Xu ..... H01R 13/506
2020/0169034 A1 * 5/2020 Zhang ..... H01R 13/639
2020/0212959 A1 * 7/2020 Eriksen ..... H02H 1/0092
2021/0005996 A1 * 1/2021 Remensperger ... H01R 13/6205
2022/0140554 A1 * 5/2022 Lybik ..... H01R 13/6675 439/39

OTHER PUBLICATIONS

Lellki Zigbee Power Strip Energy Monitoring Wifi Smart USB Socket—"https://www.aliexpress.com/i/2255800185783022.html", Retrieved Oct. 1, 2020, 2 pages.

* cited by examiner

1511

1512

MODULAR POWER SOURCE

CROSS-REFERENCE TO RELATED APPLICATIONS

This application claims priority to U.S. Provisional Patent Application No. 63/109,987, filed on Nov. 5, 2020, incorporated herein by reference in its entirety.

BACKGROUND OF THE INVENTION

Existing surge protectors and multi-socket power supplies simply provide multiple electrical sockets for more than one device to be powered from a single wall outlet at the same time. There is a need in the art for a modular power supply providing not only multiple sockets, but also more fine-grained, intelligent control and monitoring of the power consumed by connected devices, and a reconfigurable shape to provide increased flexibility and functionality. The devices and methods disclosed herein satisfy this need.

SUMMARY OF THE INVENTION

In one aspect, a modular power source comprises a middle block having a housing, comprising a connector for receiving power from a supply of electricity, and at least one electrical socket on a face of the middle block, at least one wing assembly, comprising at least one connector on a face of the wing assembly, the connector configured to form an electrical connection between the wing assembly and the inner block, and at least one controllable electrical socket, and at least one computing device configured to connect or disconnect the at least one controllable electrical socket from the power source, wherein the at least one wing assembly is configured to rotate about an axis with respect to the middle block when electrically connected to the middle block via the electrical connection.

In one embodiment, the at least one wing assembly comprises a cavity, with at least one connector positioned within the cavity. In one embodiment, the middle block comprises a rotating protrusion, the rotating protrusion comprising at least one socket, wherein the cavity on the wing assembly is configured to receive the rotating protrusion, forming the electrical connection between the at least one connector and the at least one socket. In one embodiment, the modular power source further comprises a second wing assembly, wherein the second wing assembly is configured to connect to the at least one electrical socket of the middle block.

In one embodiment, the modular power source further comprises a rotating adapter comprising at least one electrical plug connector and at least one socket, the cavity configured to receive the rotating adapter forming an electrical connection between the at least one connector in the cavity and the at least one socket. In one embodiment, the modular power source further comprises at least one sensor configured to measure a parameter of the modular power source, the sensor communicatively connected to the at least one computing device. In one embodiment, the at least one sensor is selected from the group consisting of a current sensor, a voltage sensor, a temperature sensor, an infrared sensor, an ambient light sensor, and a microphone. In one embodiment, the at least one computing device is positioned within the at least one wing assembly.

In one embodiment, the modular power source further comprises at least one DC power/communication port on a surface of the at least one wing assembly. In one embodiment, the at least one wing assembly comprising first and second wing assemblies, wherein the first and second wing assemblies each comprise a DC power/communication port on a surface of the first and second wing assemblies. In one embodiment, the modular power source further comprises a peripheral having first and second DC power/communication connectors configured to connect to the DC power/communication ports on the surfaces of the first and second wing assembles. In one embodiment, the peripheral is a wireless charger. In one embodiment, the DC power/communication ports are USB-A female ports and the DC power/communication connectors are USB-A male connectors. In one embodiment, the modular power source forms a cube having a length along each side of less than six inches.

In one embodiment, the axis is normal to the inner face of the wing assembly. In one embodiment, the at least one computing device is communicatively connected to a Wi-Fi transceiver, and the at least one computing device is configured to act as a Wi-Fi range extender. In one embodiment, the middle block further comprises a plurality of magnets positioned within the housing of the middle block, and the at least one wing assembly further comprises a ferromagnetic element configured to be positioned proximate to the plurality of magnets when the middle block is electrically connected to the at least one wing assembly.

In one aspect, a modular power source comprises at least one wing assembly, comprising at least one connector on an inner face of the wing assembly, and at least one controllable electrical socket on a front face of the wing assembly, and a rotating element comprising an inner portion and an outer portion rotatably connected to the inner portion, the outer portion configured to be removably connected to the wing assembly, and the inner portion of the rotating element is configured to rotate about an axis with respect to the wing assembly when the outer portion is electrically connected to the wing assembly.

In one embodiment, the outer portion of the rotating element comprises a plurality of rotational stops each having a contact point, and the inner portion of the rotating element comprises a plurality of detents configured to receive the plurality of contact points. In one embodiment, the inner portion comprising an annular ring comprising the plurality of detents, the plurality of detents spaced equally apart along the annular ring. In one embodiment, the plurality of rotational stops comprises four rotational stops and the plurality of detents comprise four detents. In one embodiment, the plurality of rotational stops are springs configured to be deformed when the plurality of contact points are not positioned in the detents, and restored to normal shape when the plurality of contact points are positioned in the detents. In one embodiment, the modular power source further comprises an electrical socket connector on the inner portion.

BRIEF DESCRIPTION OF THE DRAWINGS

The foregoing purposes and features, as well as other purposes and features, will become apparent with reference to the description and accompanying figures below, which are included to provide an understanding of the invention and constitute a part of the specification, in which like numerals represent like elements, and in which.

DETAILED DESCRIPTION

Figure 1:
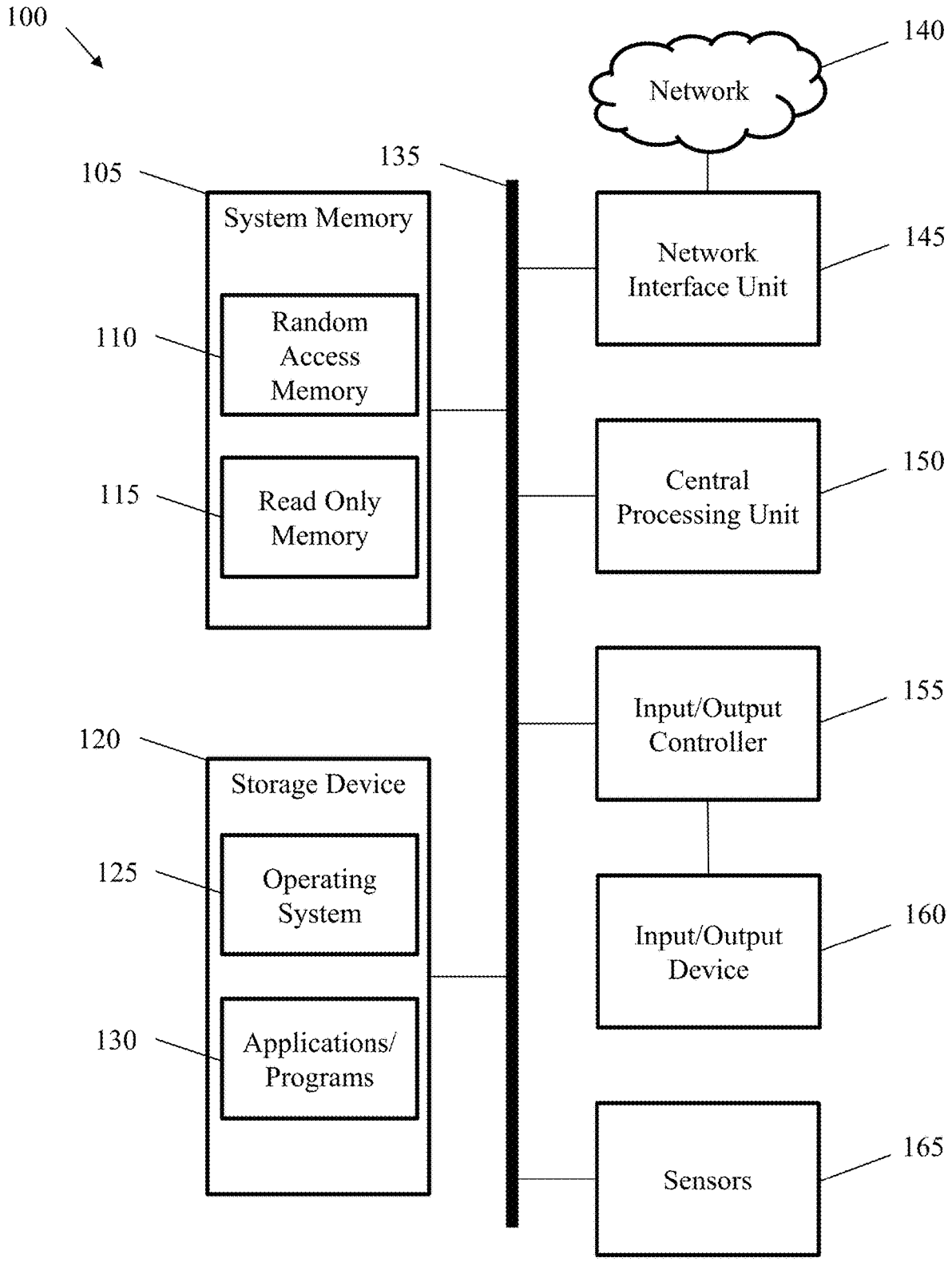
FIG. 1 is an exemplary computing device.

It is to be understood that the figures and descriptions of the present invention have been simplified to illustrate elements that are relevant for a clear understanding of the present invention, while eliminating, for the purpose of clarity, many other elements found in related systems and methods. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, exemplary methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, 6 and any whole and partial increments therebetween. This applies regardless of the breadth of the range.

In some aspects of the present invention, software executing the instructions provided herein may be stored on a non-transitory computer-readable medium, wherein the software performs some or all of the steps of the present invention when executed on a processor.

Aspects of the invention relate to algorithms executed in computer software. Though certain embodiments may be described as written in particular programming languages, or executed on particular operating systems or computing platforms, it is understood that the system and method of the present invention is not limited to any particular computing language, platform, or combination thereof. Software executing the algorithms described herein may be written in any programming language known in the art, compiled or interpreted, including but not limited to C, C++, C#, Objective-C, Java, JavaScript, MATLAB, Python, PHP, Perl, Ruby, or Visual Basic. It is further understood that elements of the present invention may be executed on any acceptable computing platform, including but not limited to a server, a cloud instance, a workstation, a thin client, a mobile device, an embedded microcontroller, a television, or any other suitable computing device known in the art.

Parts of this invention are described as software running on a computing device. Though software described herein may be disclosed as operating on one particular computing device (e.g. a dedicated server or a workstation), it is understood in the art that software is intrinsically portable and that most software running on a dedicated server may also be run, for the purposes of the present invention, on any of a wide range of devices including desktop or mobile devices, laptops, tablets, smartphones, watches, wearable electronics or other wireless digital/cellular phones, televisions, cloud instances, embedded microcontrollers, thin client devices, or any other suitable computing device known in the art.

Similarly, parts of this invention are described as communicating over a variety of wireless or wired computer networks. For the purposes of this invention, the words "network", "networked", and "networking" are understood to encompass wired Ethernet, fiber optic connections, wireless connections including any of the various 802.11 standards, cellular WAN infrastructures such as 3G, 4G/LTE, or 5G networks, Bluetooth®, Bluetooth® Low Energy (BLE) or Zigbee® communication links, or any other method by which one electronic device is capable of communicating with another. In some embodiments, elements of the networked portion of the invention may be implemented over a Virtual Private Network (VPN).

FIG. 1 and the following discussion are intended to provide a brief, general description of a suitable computing environment in which the invention may be implemented. While the invention is described above in the general context of program modules that execute in conjunction with an application program that runs on an operating system on a computer, those skilled in the art will recognize that the invention may also be implemented in combination with other program modules.

Generally, program modules include routines, programs, components, data structures, and other types of structures that perform particular tasks or implement particular abstract data types. Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

FIG. 1 depicts an illustrative computer architecture for a computer 100 for practicing the various embodiments of the invention. The computer architecture shown in FIG. 1 illustrates a conventional personal computer, including a central processing unit 150 ("CPU"), a system memory 105, including a random access memory 110 ("RAM") and a read-only memory ("ROM") 115, and a system bus 135 that couples the system memory 105 to the CPU 150. A basic input/output system containing the basic routines that help to transfer information between elements within the computer, such as during startup, is stored in the ROM 115. The computer 100 further includes a storage device 120 for storing an operating system 125, application/program 130, and data.

The storage device 120 is connected to the CPU 150 through a storage controller (not shown) connected to the bus 135. The storage device 120 and its associated computer-readable media provide non-volatile storage for the computer 100. Although the description of computer-readable media contained herein refers to a storage device, such as a hard disk or CD-ROM drive, it should be appreciated by those skilled in the art that computer-readable media can be any available media that can be accessed by the computer 100.

By way of example, and not to be limiting, computer-readable media may comprise computer storage media. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other medium which can be used to store the desired information and which can be accessed by the computer.

According to various embodiments of the invention, the computer 100 may operate in a networked environment using logical connections to remote computers through a network 140, such as TCP/IP network such as the Internet or an intranet. The computer 100 may connect to the network 140 through a network interface unit 145 connected to the bus 135. It should be appreciated that the network interface unit 145 may also be utilized to connect to other types of networks and remote computer systems.

The computer 100 may also include an input/output controller 155 for receiving and processing input from a number of input/output devices 160, including a keyboard, a mouse, a touchscreen, a camera, a microphone, a controller, a joystick, or other type of input device. Similarly, the input/output controller 155 may provide output to a display screen, a printer, a speaker, or other type of output device. The computer 100 can connect to the input/output device 160 via a wired connection including, but not limited to, fiber optic, Ethernet, or copper wire or wireless means including, but not limited to, Wi-Fi, Bluetooth, Near-Field Communication (NFC), infrared, or other suitable wired or wireless connections.

As mentioned briefly above, a number of program modules and data files may be stored in the storage device 120 and/or RAM 110 of the computer 100, including an operating system 125 suitable for controlling the operation of a networked computer. The storage device 120 and RAM 110 may also store one or more applications/programs 130. In particular, the storage device 120 and RAM 110 may store an application/program 130 for providing a variety of functionalities to a user. For instance, the application/program 130 may comprise many types of programs such as a word processing application, a spreadsheet application, a desktop publishing application, a database application, a gaming application, internet browsing application, electronic mail application, messaging application, and the like. According to an embodiment of the present invention, the application/program 130 comprises a multiple functionality software application for providing word processing functionality, slide presentation functionality, spreadsheet functionality, database functionality and the like.

The computer 100 in some embodiments can include a variety of sensors 165 for monitoring the environment surrounding and the environment internal to the computer 100. These sensors 165 can include a Global Positioning System (GPS) sensor, a photosensitive sensor, a gyroscope, a magnetometer, thermometer, a proximity sensor, an accelerometer, a microphone, biometric sensor, barometer, humidity sensor, radiation sensor, or any other suitable sensor.

Disclosed herein is a modular power supply or power station for powering, controlling, and monitoring multiple devices in a compact form factor. The disclosed device is shown in some embodiments as a cube, but it is understood that the structural concepts disclosed herein could be applied to a similar device having any suitable shape.

Figure 2:
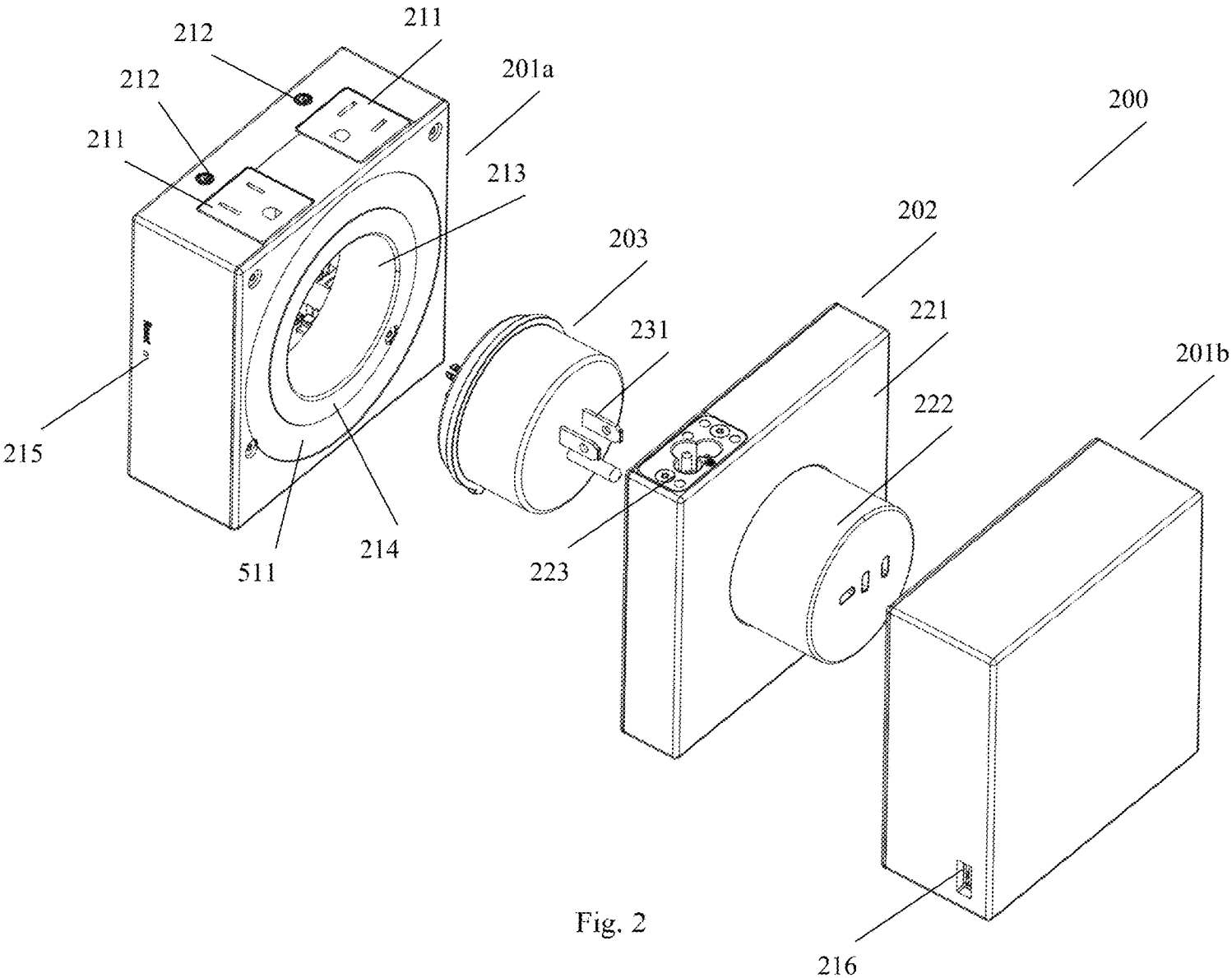
FIG. 2 is an exploded view of a modular power supply.

With reference to FIG. 2, an exemplary exploded view of a modular device 200 of the present disclosure is shown. The device 200 includes two wings 201*a* and 201*b*, which in some embodiments are identical and interchangeable. Both wings 201*a* and 201*b* are configured to connect to middle block 202. Wing 201*a* is configured to connect to the left face of middle block 202 using rotational adapter 203, while wing 201*b* is configured to connect to the right face of middle block 202, specifically via the rotating protrusion 222.

As shown in FIG. 2, wing 201*a* includes two electrical sockets 211 and two corresponding indicator/control elements 212 on a first face of the wing 201*a*. In some embodiments, a wing 201*a* may include one or more additional control elements, for example reset button 215. The wing 201*a* further may include a cavity 213 configured to receive the rotating adapter 203. The adapter 203 in turn may be connected to middle block 202 via a two-prong or three-prong electrical socket 231. Wing 201*b* may further comprise one or more DC power and/or communication connectors 216, which in the depicted embodiment is a female USB-A port, but may alternatively be a female USB-B port, a female USB-C port, or any other suitable connector. Although the electrical socket 231 shown in FIG. 2 is a NEMA 5-15 grounded three prong electrical socket, it is understood that a different rotating adapter 203 may be swapped in to a device of the present disclosure having a different electrical socket 231, for example an electrical socket suitable for use in other countries, including but not limited to a CEE 7 plug, a BS 546 plug, a GB 2099.1-2008 plug, etc. Similarly, in some embodiments middle dock 202 may comprise an electrical socket 321 (see FIG. 3) corresponding to one or more of the electrical sockets 231 on various rotating adapters 203.

In some embodiments, indicator/control elements 212 may comprise an illumination element, for example and LED or multicolored LED, and/or a button for toggling or adjusting one or more parameters of corresponding electrical sockets 211. For example, a indicator/control element 212 may include an LED which illuminates green when power is being provided to the corresponding electrical socket 211, and may illuminate red or not illuminate when no power is being provided to the corresponding electrical socket 211. In some embodiments, a yellow or red illumination may indicate a fault in electrical socket 211. In some embodiments, pressing on a button integrated into indicator/control element 212 may toggle power to the corresponding electrical socket 211 on or off.

Middle block 202 is configured to connect to both wings 201*a* and 201*b* and also to mains electric for example via socket 223. Rotating protrusion 222 is configured to rotate relative to main body 221 of middle block 202.

Figure 3:
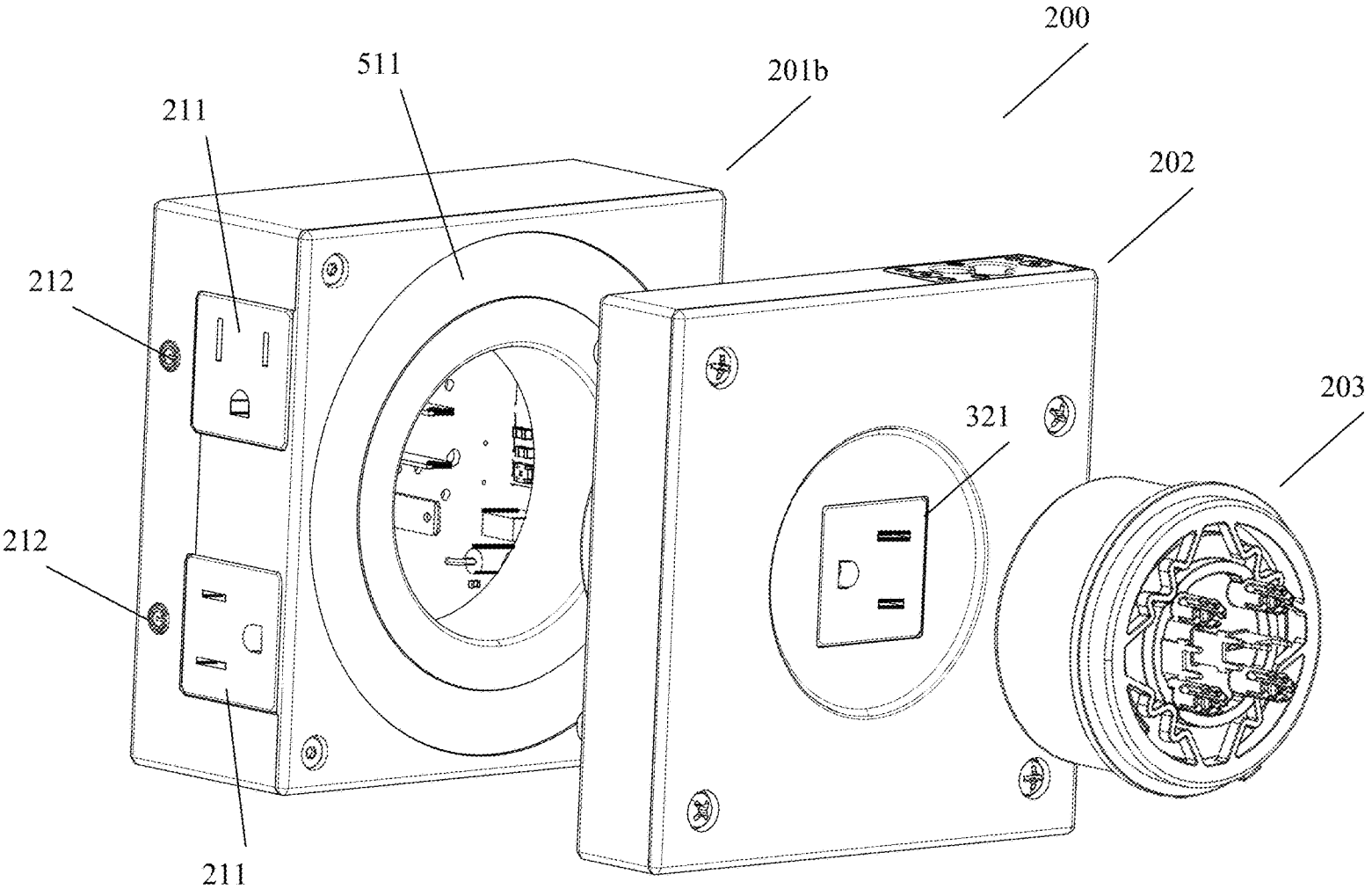
FIG. 3 is an exploded view of a modular power supply.

With reference to FIG. 3, an alternate exploded view of device 200 is shown from the opposite side, including the middle block 202 and illustrating how the rotating adapter 203 connects to the electrical socket 321 on the face of middle block 202. Like the rotating protrusion 222, the rotating adapter 203 may be configured to rotate relative to middle block 202. Although in the depicted embodiment, the rotating adapter 203 is shown with male connection terminals, it is understood that in some embodiments the connection terminals may be female connection sockets, for example as shown in FIG. 4A.

Figure 4A:
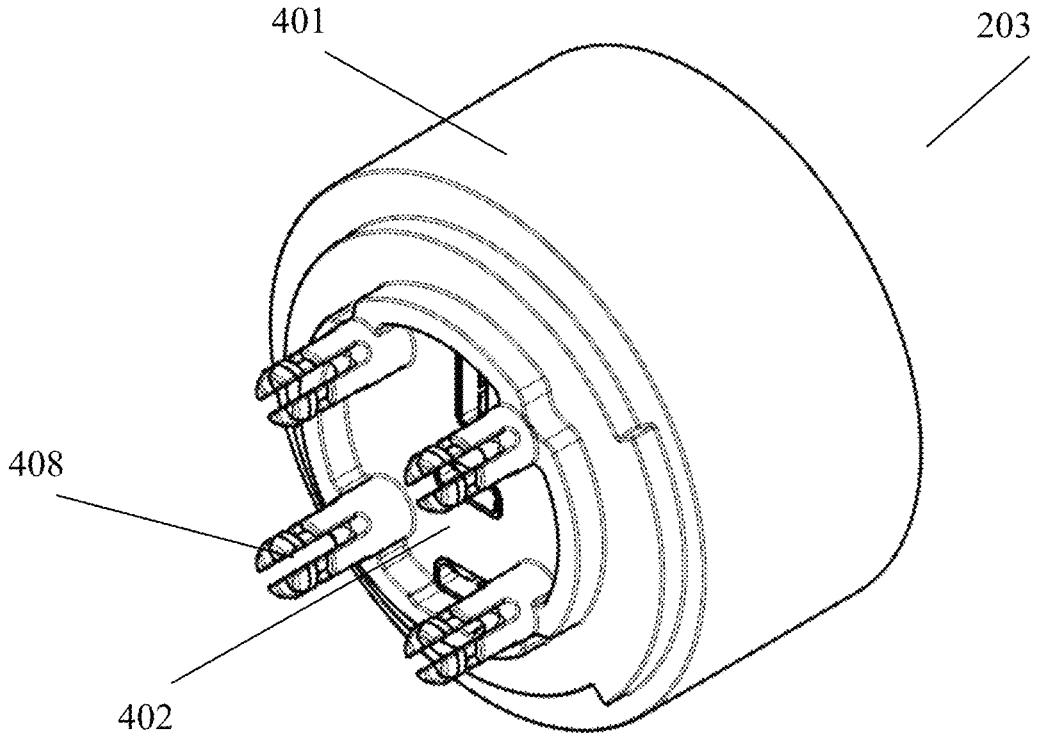
FIG. 4A is a perspective view of a rotating adapter of a modular power supply.
Figure 4B:
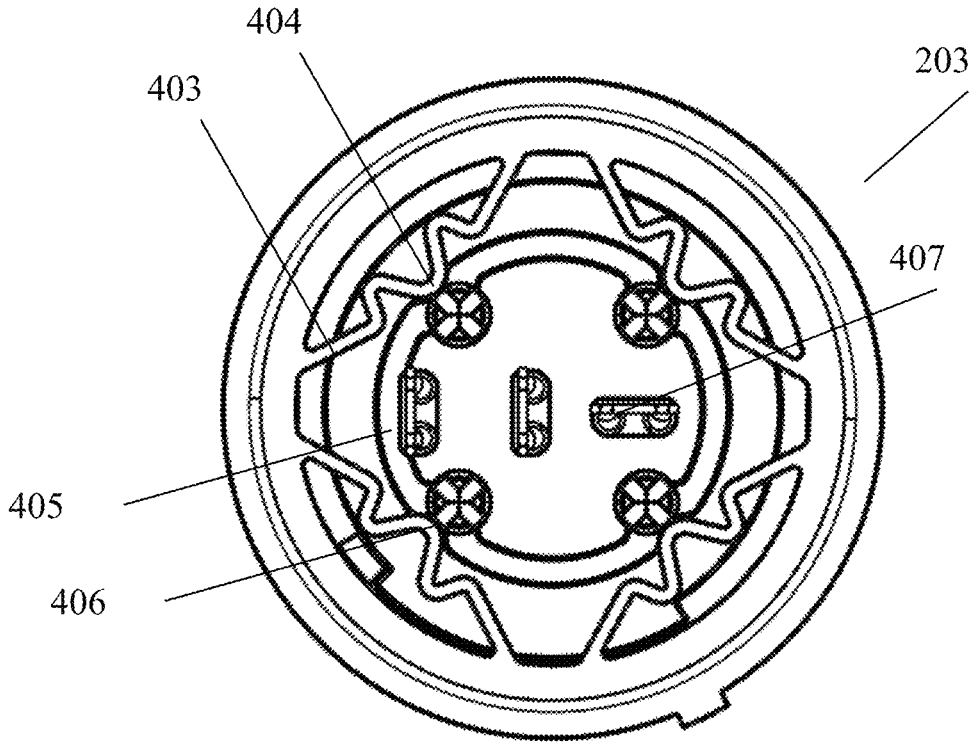
FIG. 4B is a front view of a rotating adapter of a modular power supply.

Detail views of rotating adapter 203 are shown in FIG. 4A and FIG. 4B. As shown in FIG. 4A, the rotating adapter 203 may comprise an outer portion 401 and an inner portion 402, wherein the outer portion 401 rotates about the inner portion 402. As shown in FIG. 4B, the outer portion may comprise one or more rotational stops 403, the four rotational stops in the depicted example may be considered in some embodiments as springs, being formed as a jagged, sinusoidal, or sawtooth line having a central contact point 404. The rotational stop may be made from any suitable material, including but not limited to a plastic, for example ABS, or metal, for example aluminum, plastic, for example recycled plastic, metals, wood composites, carbon fiber, or the like. As shown in FIG. 4B, annular ring 405 may be configured with one or more detent or catch points 406, configured to receive the contact point 404 of any of rotational stops 403 and arrest the rotation of outer portion 401 relative to inner portion 402 at one or more fixed positions, in the depicted example every 90 degrees. The depicted rotational stop 403 may be configured to elastically deform such that during rotation, the contact point 404 slides along an outer surface of annular ring 405 of inner portion 402. When the contact point 404 reaches a detent 406 on the annular ring 405, the restoring force of the spring pushes the contact point 404 into the detent 406, arresting the rotation of the outer portion relative to the inner portion. The arresting force of the rotational stops 403 in detents 406 may be overcome by applying a torsional force to one or both of the inner portion 402 and the outer portion 401, which may by fixedly attached in an assembled configuration to a wing 201*a* and the middle block 202, respectively.

Additionally, the rotating adapter 203 may include one or more electrical contacts 407, for example spade terminals, fork terminals, or any other suitable connectors. In some embodiments, the electrical contacts 407 retract into the body of rotating adapter 203 when making contact with the opposing connectors in the wing 201*a* or 201*b*. In some embodiments, electrical contacts may be male connection terminals, as shown in FIG. 3, but in other embodiments, the electrical contacts may be female connection terminals, as shown in FIG. 4A. The rotating adapter 203 may further include one or more spacers or mechanical connectors 408 (four in the depicted example) configured to mechanically attach inner portion 402 to a wing 201*a* or 201*b*.

Figure 5A:
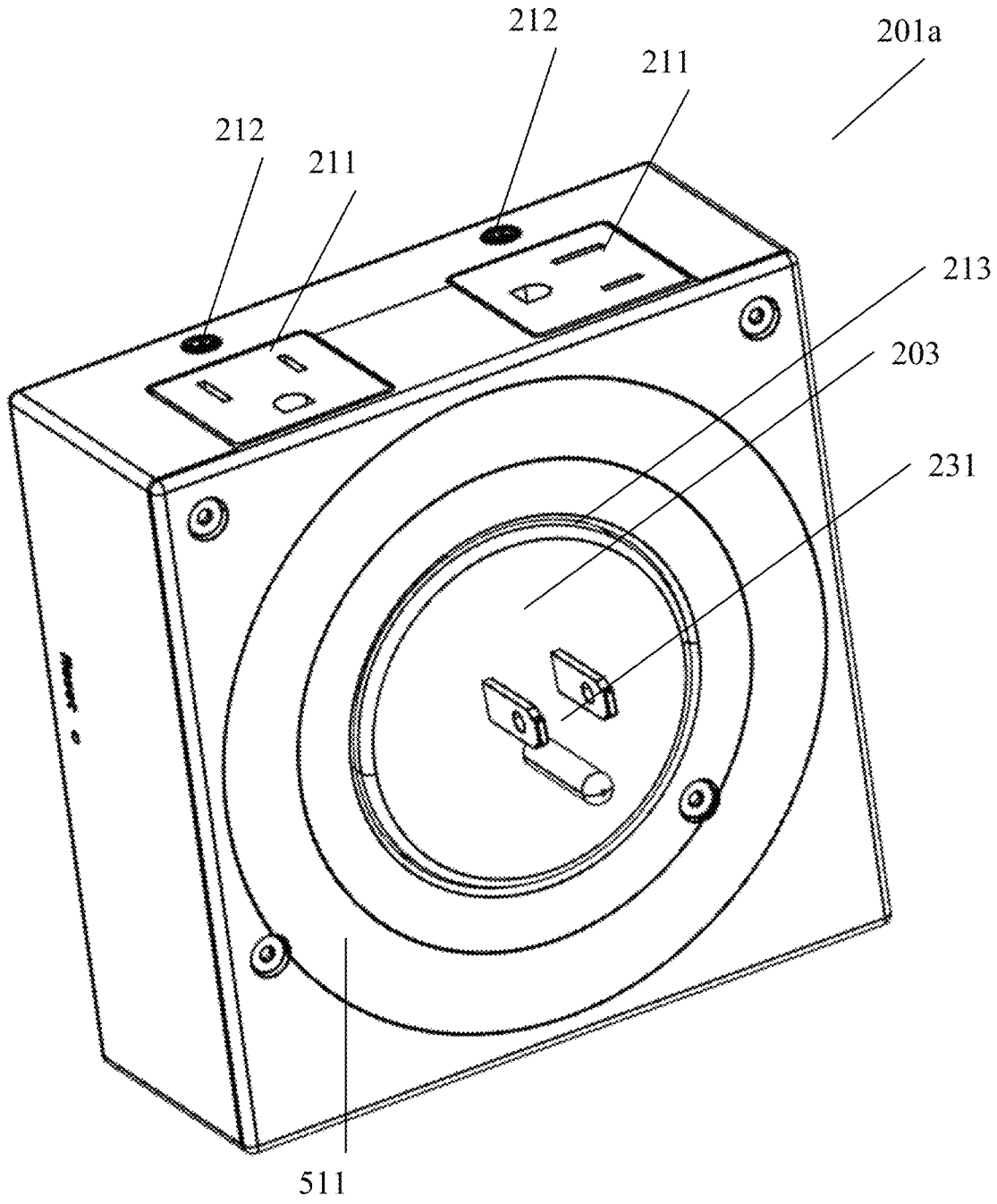
FIG. 5A is a left wing of a modular power supply with the rotating adapter connected.

A detail view of a wing 201*a* is shown in FIG. 5A, having rotating adapter 203 seated inside cavity 213. As discussed above, in the connected configuration, the electrical socket 231, being fixedly connected to outer portion 401 of rotating adapter 203, will rotate within cavity 213 with respect to the body of wing 201. In some embodiments, the rotating adapter may be configured to rotate freely in either direction, but in other embodiments, the rotating adapter may be limited by one or more mechanical stops to a 360 degree total rotation (e.g. 180 degrees in either direction) a 270 degree total rotation, a 180 degree total rotation, a 90 degree total rotation, or any other suitable range of rotation. In some embodiments, a rotating adapter 203 may comprise coiled wires within similar to coiled wires 605 in the middle dock (see FIG. 6B). Inner coiled wires (not shown) may serve the same function as the coiled wires 605 in middle dock 202, that is to allow for some degree of rotation without straining, damaging, or severing the electrical connection from one side of the rotating adapter to the other.

Figure 5B:
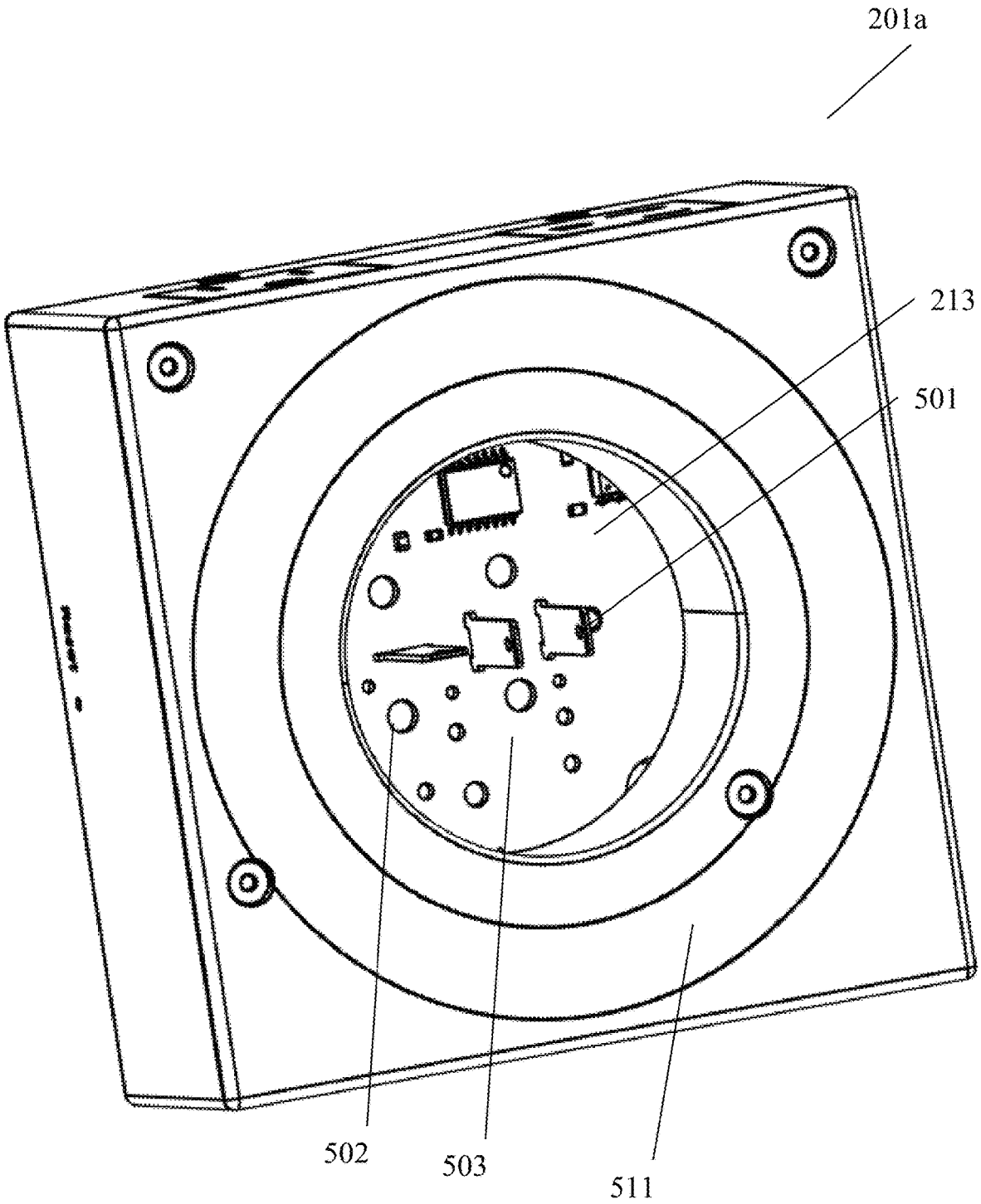
FIG. 5B is a left wing of a modular power supply with the rotating adapter removed.

A further detail view of a wing 201*a* is shown in FIG. 5B, in this embodiment having rotating adapter 203 removed from cavity 213. In conjunction with FIG. 4A and FIG. 4B, FIG. 5B illustrates how rotating adapter 203 electrically and mechanically connects to wing 201*a* in the depicted embodiment. As shown, the wing comprises one or more (three in the depicted embodiment) connectors, for example spade connectors 501, protruding from an inner surface 503 of cavity 213. Spade connectors 501 may comprise any conductive material, including but not limited to copper, aluminum, steel, silver, or the like. In the depicted embodiment, two spade connectors are oriented in a first orientation while a third is oriented perpendicular to the others, in order to prevent the rotating adapter from being connected backwards. The spade connectors may be configured to selectively deliver power, for example alternating current power, from the middle dock 202 to a wing, for example wing 201*b*. The inner surface 503 of cavity 213 may further comprise one or more mounting holes 502 configured to receive mechanical connectors 408 of rotating adapter 203. In the depicted embodiment, four identical mechanical connectors and four corresponding identical holes are arranged in a square, but in other embodiments, one or more of the mechanical connectors may be keyed or offset from the others in order to further ensure correct connector orientation of the rotating adapter 203.

Also visible in FIG. 5B is the magnetic ring 511, which may in some embodiments comprise a ferromagnetic material, for example iron, nickel, cobalt, or alloys thereof. The magnetic ring 511 may further comprise a plastic shell positioned over the ferromagnetic material. The magnetic ring 511 is configured to be attracted to magnets 606 positioned in middle block 202 (see FIG. 6B) in order to hold the wing 201*a* in position when connected to middle block 202. In some embodiments, the magnetic ring 511 is configured to provide a feeling of snapping into place when brought close enough to the magnets 606.

Figure 4C:
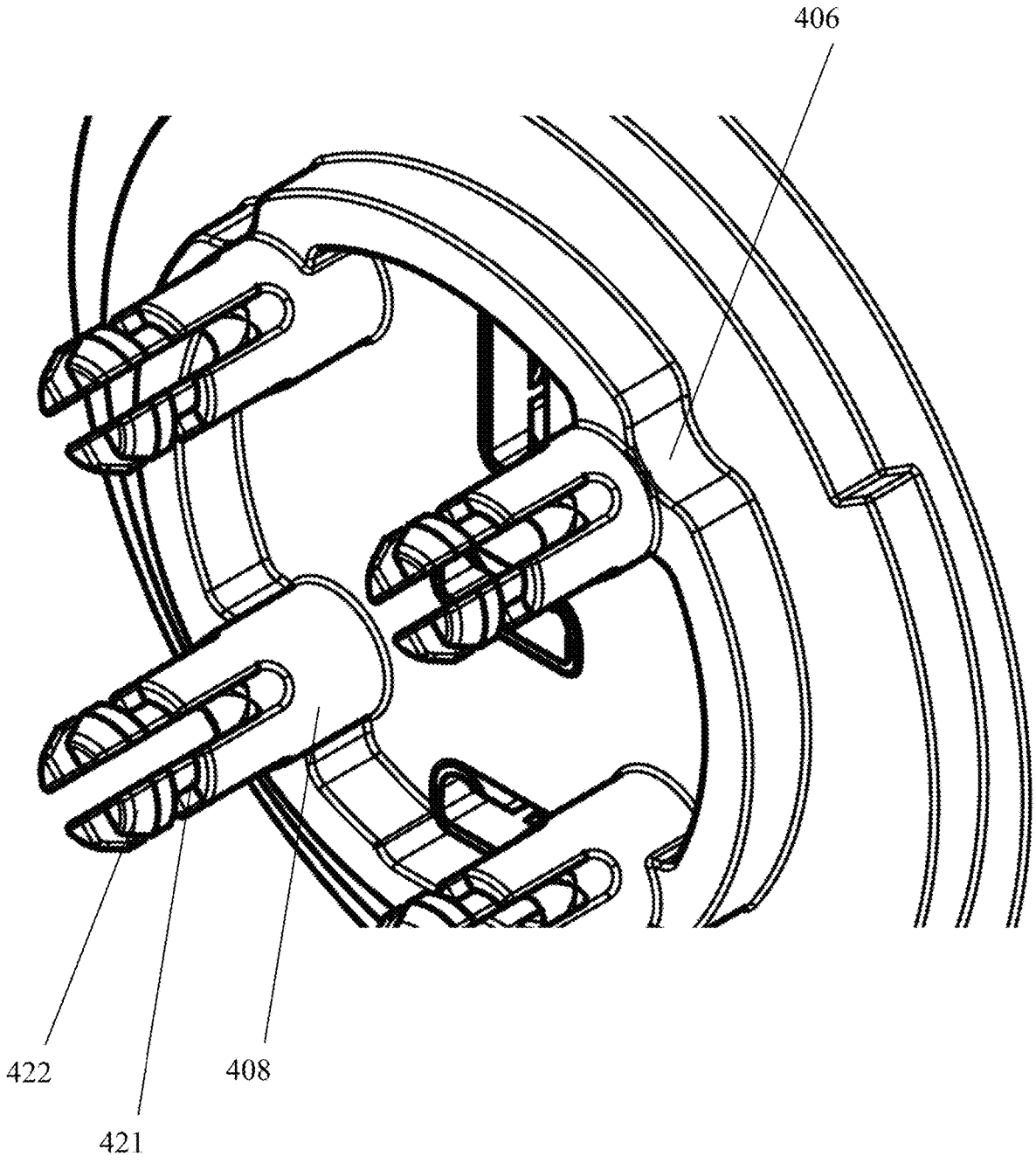
FIG. 4C is a detail view of a rotating adapter of a modular power supply.

In some embodiments, and with reference to FIG. 4C, the mechanical connectors 408 comprise one or more tabs 421 arranged in a circle and the mounting holes 502 have a diameter slightly less than a maximum outer diameter of circle of tabs 421 in the mechanical connectors 408, and are configured to receive mechanical connectors 408 such that pressing mechanical connectors 408 into holes 502 bends the tabs 421 inward, allowing a leading portion of the mechanical connector to pass through the holes 502 until a securing portion 422 of the tabs 421 enters the holes 502, allowing the tabs 421 to bend back to their original shape, securing the mechanical connector 408 into the hole 502. In some embodiments, the distal end of one or more of the tabs 421 may be tapered in a direction toward the top of the mechanical connector 408 and/or in a direction toward the securing portion 422 of the tab 421, so that the mechanical connector 408 may be configured to remain positioned in the hole 502 until a sufficient force is applied to pull the mechanical connector 408 out of the hole 502.

Figure 6A:
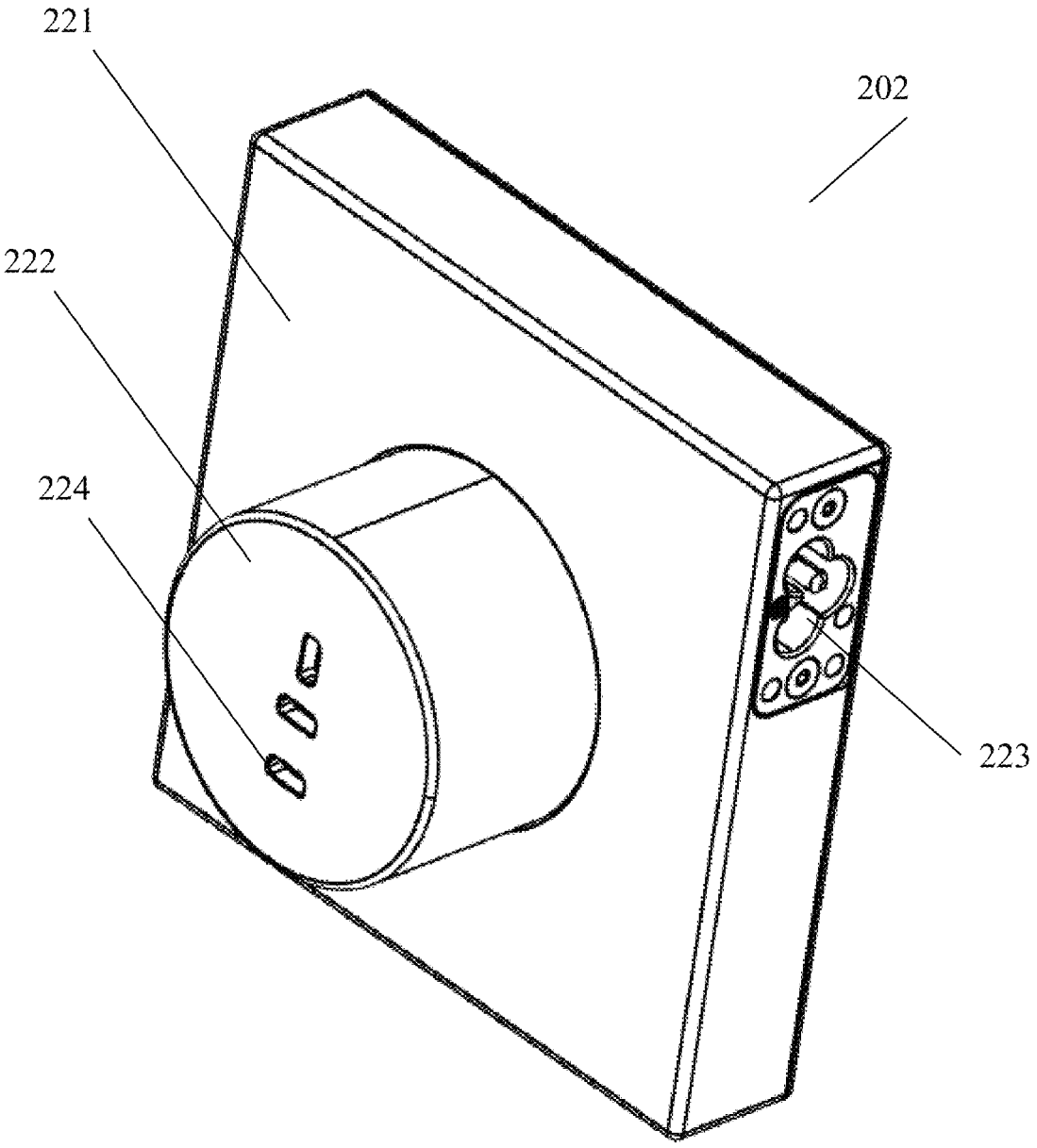
FIG. 6A is a detail view of a middle block of a modular power supply.

With reference to FIG. 6A, a detail view of an exemplary middle block 202 is shown, having body 221 and rotating protrusion 222 which is configured to rotate relative to middle block 202. The rotating protrusion 222 includes three sockets 224 corresponding to the three connectors 501 on the wing 201*a*, configured to receive the connectors 501 when wing 201*a* is connected to rotating protrusion 222 of middle block 202.

Figure 6B:
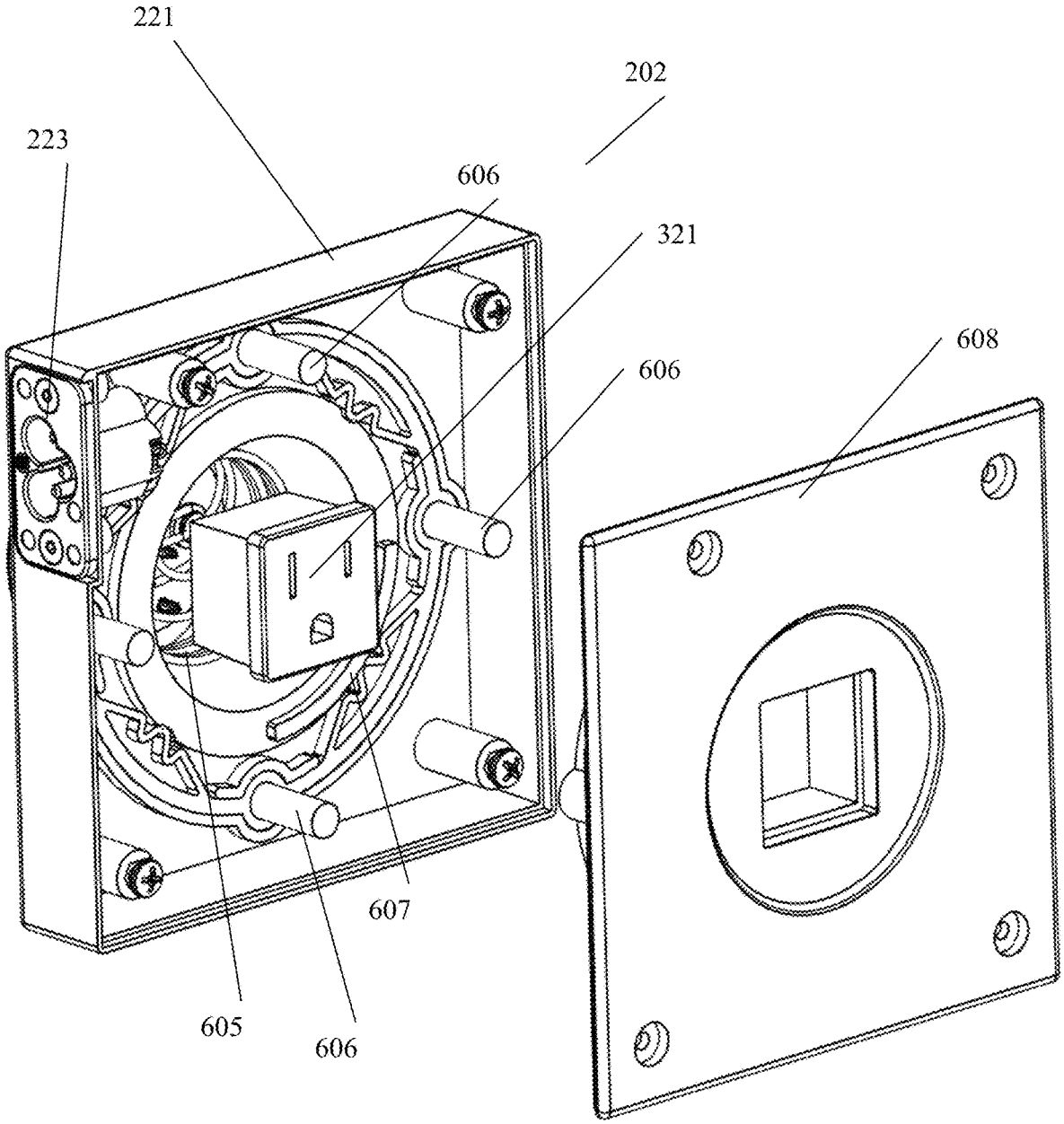
FIG. 6B is an exploded view of a middle block of a modular power supply.

With reference to FIG. 6B, an exploded view of an exemplary middle block 202 is shown with the body 221 open. The electrical socket 321 is visible, and behind the electrical socket the inner surface of an exemplary rotating protrusion 222 is shown. In the depicted embodiment, the electrical sockets 224 of the rotating protrusion 222 are electrically connected to the rest of the assembly via coiled wires 605, which sit inside the rotating protrusion 222 and coil and uncoil as the rotating protrusion is rotated within a fixed angle, which may in some embodiments be 270 total degrees. In some embodiments, the rotation of the rotating protrusion may be controlled or limited by a mechanical stop, for example mechanical stop 607, which may be positioned for example within a circular channel (not shown) on the opposite face 608 of body 221.

Also visible in the exploded view of FIG. 6B are the magnets 606. The depicted embodiment comprises four magnets 606 positioned at 90 degree intervals in the middle body, but it is understood that any number of magnets could be used. In some embodiments, the magnets comprise a rare earth metal, including but not limited to neodymium. In some embodiments, the magnets are permanent magnets. In one embodiment, the magnets 606 are configured to hold a wing in place on the device via the magnetic ring 511 (see e.g. FIG. 5B). In some embodiments, the magnetic ring 511 comprises a ferromagnetic material configured to be attracted to the magnets 606.

Figure 7A:
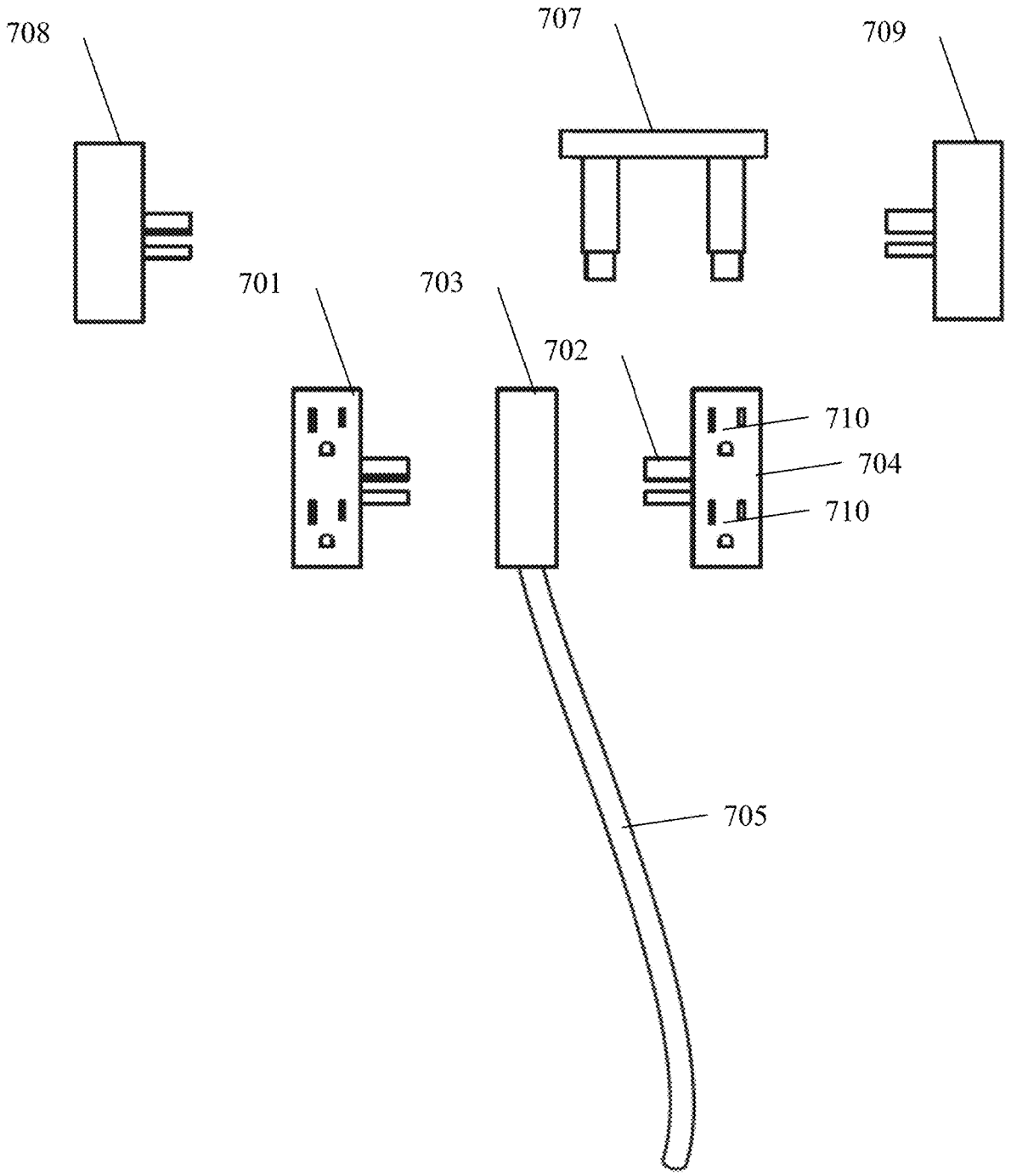
FIG. 7A is an of exploded view of a modular power supply.
Figure 7C:
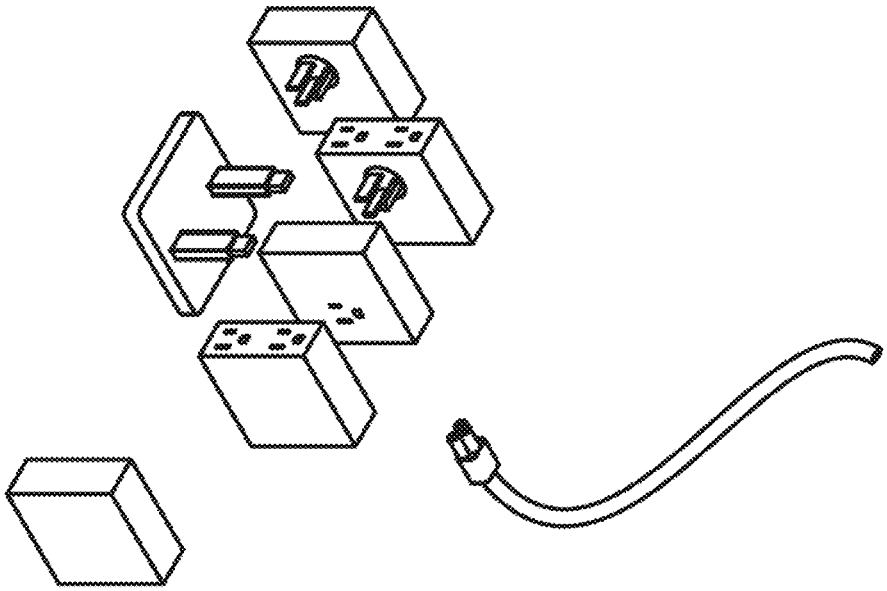
FIG. 7C is an of exploded view of a modular power supply.
Figure 7B:
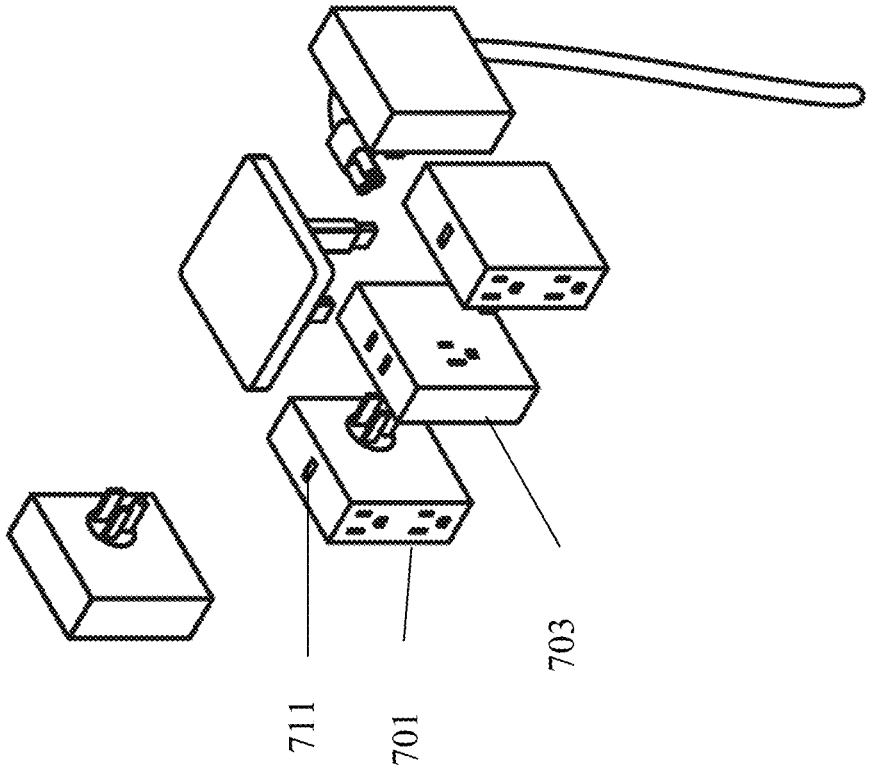
FIG. 7B is an of exploded view of a modular power supply.

With reference to FIGS. 7A, 7B, and 7C, a variety of exploded views of another exemplary device of the present disclosure are shown. The depicted device includes a left wing 701 and a right wing 704, each having two standard electrical sockets 710 each configured to receive an electrical plug connector on a front face, and each having an electrical wing 702 on an inner face orthogonal to the front face. In some embodiments, the electrical plug connector 702 rotates about an axis normal to the inner face. In one embodiment, each of the left and right wings 701 and 704 comprises a slip ring mechanism for maintaining electrical connectivity while the electrical plug connector 702 rotates about the axis. In one embodiment, one or both of the left and right wings 701 and 704 comprise a rotating electrical connection mechanism comprising coiled wires as shown in FIG. 6B. Each of the left wing 701 and right wing 704 may comprise one or more DC power and/or communication connectors 711, for example along a top face orthogonal to both the front face and the inner face as recited above. The DC power and/or communication connector 711 may be selected from a USB A port, a USB-C port, a FireWire connector, a Lightning connector, or any other suitable connector.

In various embodiments one or more components of a modular power source may comprise any suitable materials, for example metals such as aluminum, or steel, polymers such as ABS, ceramics, glass, or combinations thereof. In some embodiments, one or more components may comprise a metal with an oxidized or anodized outer surface.

The depicted left 701 and right 704 wings may be used independently, i.e. each of the left 701 and right 704 wing assemblies may be plugged into a wall outlet, extension cord, or surge protector to provide power to one or more additional electrical devices via the one or more electrical sockets on the front face, and/or one or more DC powered devices via the one or more DC power and/or communication connectors 711 on the top face.

In some embodiments, a device may include a middle block 703, for example the depicted middle block having a size equal to or roughly equal to the size of the left wing 701 and right wing 704. A more detailed view of the middle block 703 is shown in FIG. 12A, FIG. 12B, FIG. 12C, and FIG. 12D. In some embodiments, the height 1211 and depth 1212 of the middle block 703 may be equal or roughly equal to the height 1011 or 1111 and depth 1012 or 1112 of the left wing 701 and/or right wing 704, while the width 1213 is wider or narrower than the width 1011 or 1111 of the left and/or right wings 701 and 704. In some embodiments, when the middle block 703 is joined to a left wing 701 and a right wing 704, the three elements together form a body which is cubical or substantially cubical. In the depicted embodiment, the left wing 701 and right wing 704 connect to the middle block 703 at least via insertion of the electrical plug connectors 702 into corresponding sockets 1201 and 1202 on the outer faces of the middle block 703. In embodiments where the electrical plug connectors 702 are rotatable with respect to the left wing 701 and right wing 704, the left wing 701 and right wing 704 may be configured to rotate about an axis with respect to the middle block 703. In some embodiments, left wing 701 and/or right wing 704 may rotate freely about middle block 703 while electrically connected via electrical plug connectors 702, i.e. they may rotate indefinitely in either direction without a mechanical stop. In other embodiments, left wing 701 and/or right wing 704 may rotate 360 degrees, 270 degrees, 180 degrees, or 90 degrees about the axis, prevented from rotating further by a mechanical stop.

In one embodiment, left wing 701 and/or right wing 704 may be configured to rotate outward from the middle block 703 via a hinge or other element, for example to a position perpendicular to middle block 703. In one embodiment, left wing 701 and/or right wing 704 may be rotatable about some other axis with respect to middle block 703, for example hingedly connected to the bottom, top, rear, or front edge. In such embodiments, electrical connectivity may be maintained with the middle block for example by a retractable or telescoping connector or via an electrical connection positioned within or incorporated into the hinge.

In some embodiments, a device may include one or more peripherals connectable to DC power and/or communication connectors on the top faces of one or more of the left wing, the right wing, or the middle block. In one embodiment, a peripheral 707 may connect to USB-A connectors 1004 and 1104 on the left wing and the right wing as shown. In one embodiment, the peripheral 707 (see FIG. 13A, FIG. 13B, and FIG. 13C) may be a wireless charger configured with a top wireless charging surface 1301 for wirelessly transferring power to a device positioned on the wireless charging surface 1301. A wireless charger may use one or more of any wireless charging standards known in the art. In one embodiment, a wireless charger or other peripheral 707 may comprise two DC power and/or communication connectors 1302 for connecting to the left and right wings 701 and 704, wherein one or both DC power and/or communication connectors 1302 are configured to deliver DC current to the wireless charger. In some embodiments, only one DC power and/or communication 1302 connector is configured to transfer power to the peripheral, where the other DC power and/or communication connector 1302 is not electrically connected but merely used to stabilize the peripheral 707 while in use.

In some embodiments, a device may include a left battery 708 and/or a right battery 709 configured to connect to the middle block 703 via connectors similar to electrical plug connectors 702 on the left wing 701 and right wing 704. In some embodiments, the electrical plug connectors on the inner surfaces of the left battery 708 and/or right battery 709 may be configured to charge the batteries when the middle block 703 is connected to mains electric, and may be configured to power one or more devices electrically connected to middle block 703 (e.g. via an inverter) when the middle block 703 is not connected to mains electric. In some embodiments, the left battery 708 and/or right battery 709 may include a secondary DC power connector (not shown) connecting the left battery 708 and/or right battery 709 to the middle block 703. In one such embodiment, the electrical plug connectors on the inner surface of left battery 708 and/or right battery 709 may not be electrically connected to left battery 708 and/or right battery 709, but may be used only to form a mechanical connection with middle block 703.

In the depicted embodiment, middle block 703 includes a receptacle 1203, for example on a rear face opposite the front face, configured to receive an AC electrical cable 705 for connectivity to mains electric. The receptacle on the rear face may be any suitable receptacle for providing AC power to the middle block 703. In some embodiments, middle block 703 may include a fixedly-attached electrical cord 705 for connecting the middle block 703 to mains electric.

In some embodiments, the device includes a computing device, for example a microcontroller or single-board computer, embedded within one or more of the middle block 703, the left wing 701, the right wing 704, the left battery 708, or the right battery 709. The one or more computing devices may be configured to communicate wirelessly or via a wired communication link with each other and with other networked computing devices. In one embodiment, one or more computing devices may be configured to communicate with a smartphone via a Bluetooth or Wi-Fi connection. In one embodiment, one or more of the left or right wing may comprise an embedded computing device configured to communicate via a wired or wireless connection with a computing device positioned in the middle block 703. In one such embodiment, the computing device in the middle block may be configured to communicate via a wireless connection with outside devices, for example a smartphone.

In some embodiments, one or more embedded computing devices in a device of the disclosure may be configured to communicate with an external server, computer, laptop, smart phone, tablet, or cloud server via Wi-Fi.

In one embodiment, one or more embedded computing devices in a modular power source of the disclosure may be configured to monitor one or more characteristics of the modular power source or the devices receiving power from the modular power source. Examples of some measured characteristics include, but are not limited to, electrical current drawn by one or more devices electrically connected to the modular power source, voltage drop across one or more electrically connected devices, temperature at one or more points in or on the modular power source, ambient light at one or more points on the surface of the modular power source, and sound, for example via a microphone. In some embodiments, an embedded computing device may comprise an infrared or sound receiver, for example for receiving control signals via infrared (e.g. a photodiode configured to receive an infrared signal from a remote control) or sound (for example via a microphone configured to detect a specific sound or speech pattern or ultrasonic signal).

In one embodiment, one or more embedded computing devices may comprise control logic configured to control various aspects of the modular power source, for example to turn power off or on to one or more electrical sockets 1002, 1201, or 1202 on a face of a component (e.g. middle block, left wing, right wing, left battery, right battery) of the modular power source, for example in response either to a manual control signal or in response to one or more measurements from one or more sensors positioned in the modular power source or elsewhere. Control logic may include control of one or more indicator lights on a face of the modular power source, one or more speakers or transducers configured to deliver sound signals.

In one embodiment, one or both of the left and/or right wings 701, 704 includes overcurrent and overvoltage protection. Overcurrent protection may comprise a circuit breaker, fuse, or resettable fuse.

In one embodiment, a modular power supply may comprise one or more computing devices configured to act as a Wi-Fi range extender. For example, a modular power supply may comprise a single computing device communicatively connected to with one or more Wi-Fi transceivers, with one transceiver maintaining a Wi-Fi connection to a nearby access point, and a second transceiver making itself available as an access point for connections from devices within range of the second transceiver. In one embodiment, both operations are performed by a single Wi-Fi transceiver connected to a single computing device. In one embodiment, a first computing device, for example positioned in one of the left or right wing 701 or 704, may act as the transceiver maintaining the connection to the access point, while a second computing device, for example positioned in the other of the left or right wing 701 or 704, may act as the access point for connections from nearby devices. The two computing devices may then bridge the connections between the two transceivers via any method known in the art, for example a secondary wireless or wired communication channel between the two computing devices.

Figure 8C:
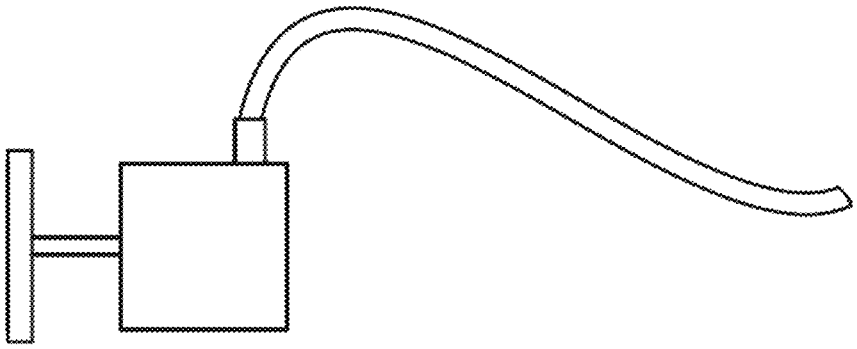
FIG. 8C is a view of a modular power supply in a first configuration.
Figure 8B:
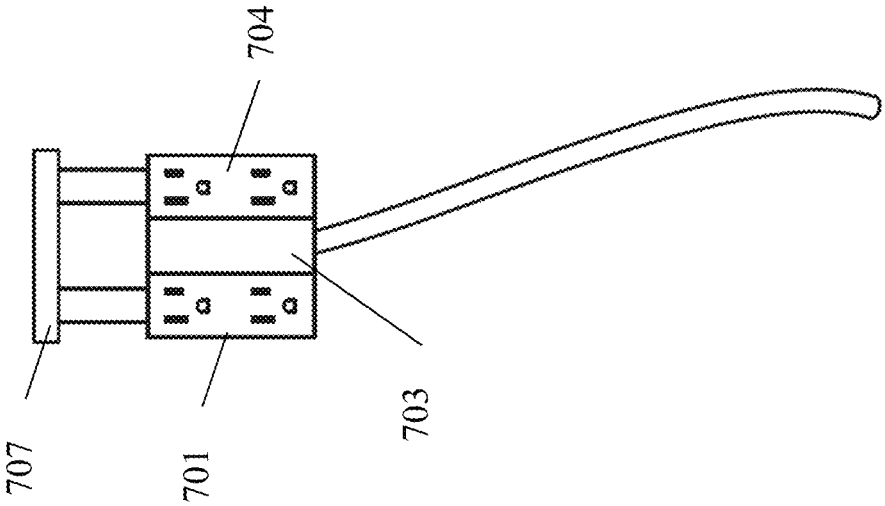
FIG. 8B is a view of a modular power supply in a first configuration.
Figure 8A:
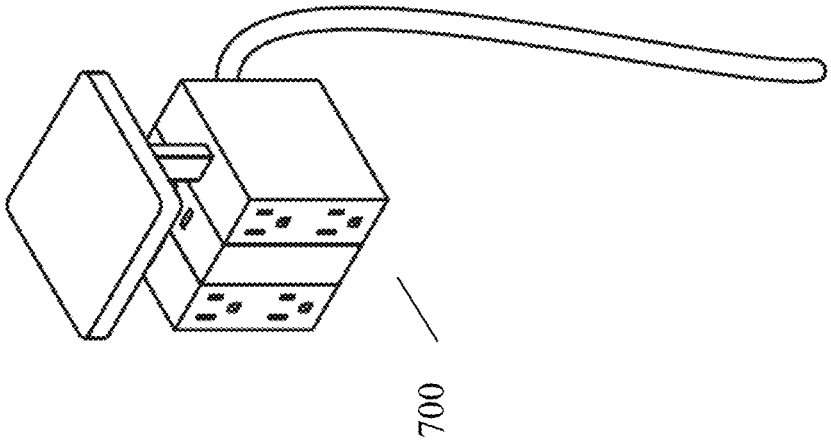
FIG. 8A is a view of a modular power supply in a first configuration.

With reference to FIG. 8A, FIG. 8B, and FIG. 8C, views of an assembled modular power source 700 are shown with the left and right wings 701 and 704 connected to the middle block 703, and a peripheral 707 connected to the DC power/communication ports 1004 and 1104. In the depicted embodiment, the assembled device 700 is a cube. In some embodiments, the assembled device 700 may be a cube having a length on each side of less than 6 inches, or between 2.5 inches and 7 inches, or between 3 inches and 5.5 inches, or between 3.5 inches and 4.75 inches, or between 4 inches and 4.5 inches, between 4.25 and 4.5 inches, or about 4.25 inches or about 4.5 inches.

Figure 9C:
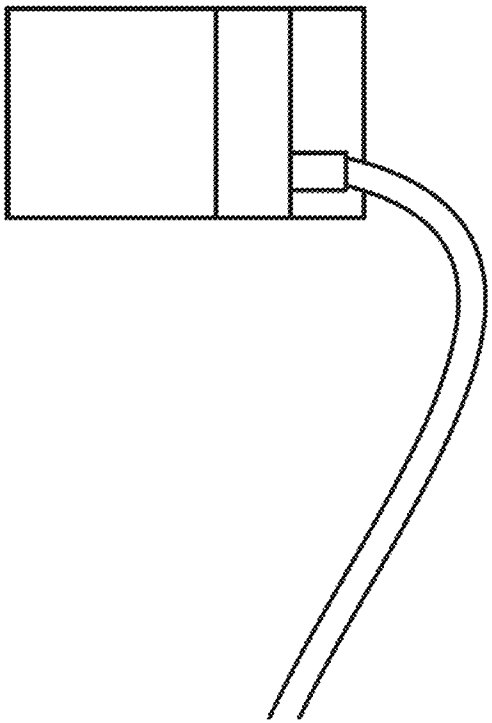
FIG. 9C is a view of a modular power supply in a second configuration.
Figure 9B:
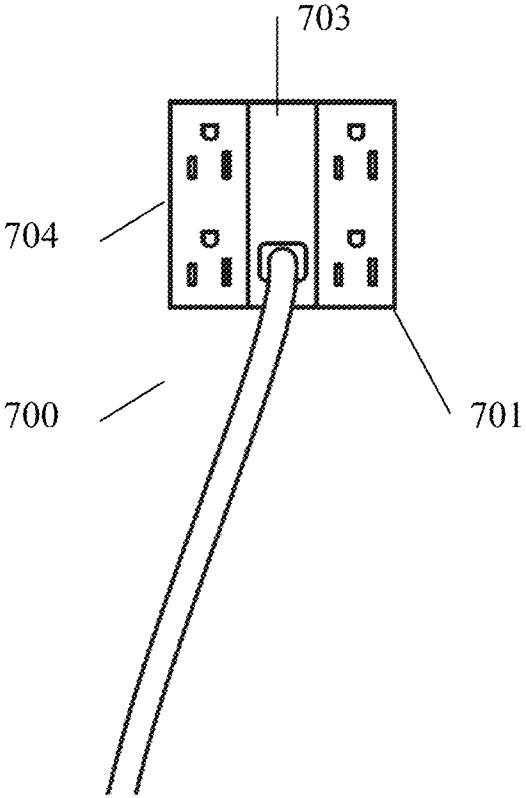
FIG. 9B is a view of a modular power supply in a second configuration.
Figure 9A:
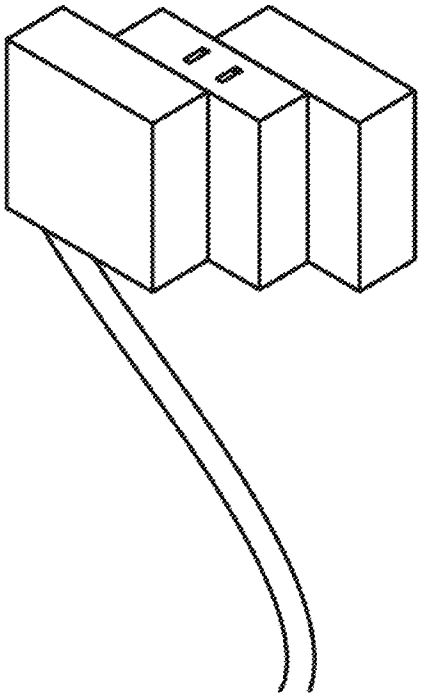
FIG. 9A is a view of a modular power supply in a second configuration.

With reference to FIG. 9A, FIG. 9B, and FIG. 9C, a view is shown of the assembled modular power source 700 with the left wing 701 and the right wing 704 each rotated 180 degrees with respect to the middle block 703. In the depicted embodiment, (and with further reference to FIG. 7A and FIG. 7B) the electrical plug connectors 702 on the inner surfaces of left wing 701 and right wing 704 are off-center along the axis running from the front face to the rear face of the left and right wings (axis 1012 in FIG. 10C and axis 1112 in FIG. 11C). Therefore, when both are rotated 180 degrees, the left and right wings are no longer in alignment, and so the cube shape becomes a staggered shape resembling a flight of stairs (see FIG. 9A).

Figure 10A:
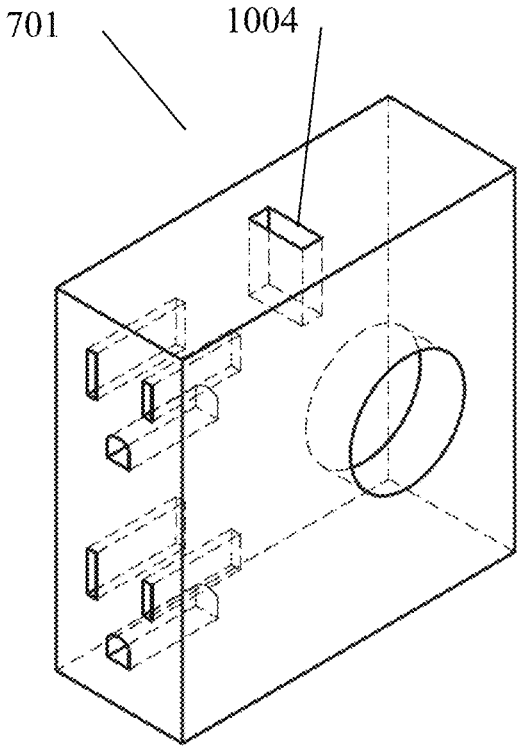
FIG. 10A is a view of a left wing of a modular power supply.
Figure 10B:
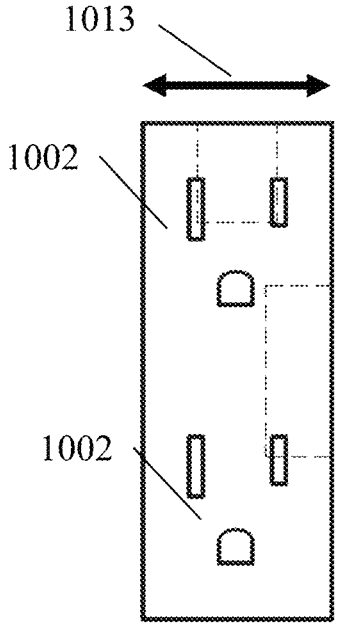
FIG. 10B is a view of a left wing of a modular power supply.
Figure 10C:
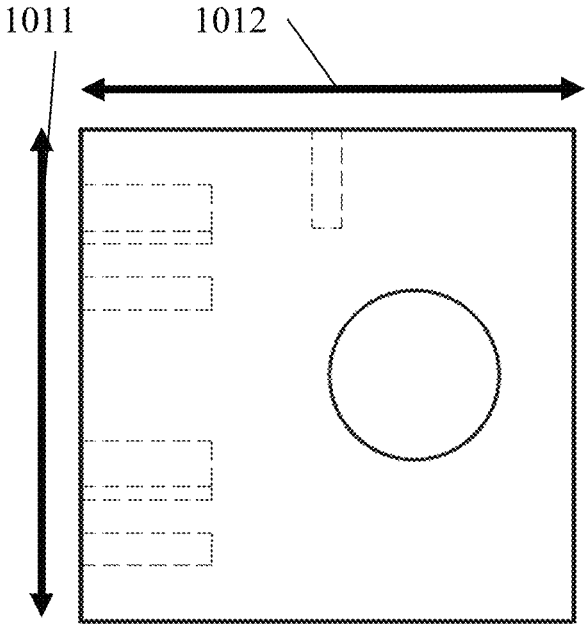
FIG. 10C is a view of a left wing of a modular power supply.
Figure 10D:
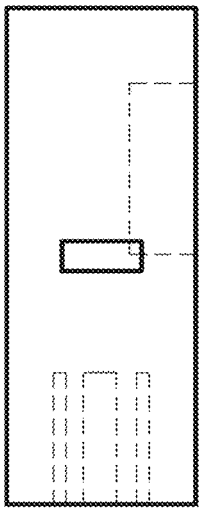
FIG. 10D is a view of a left wing of a modular power supply.
Figure 11A:
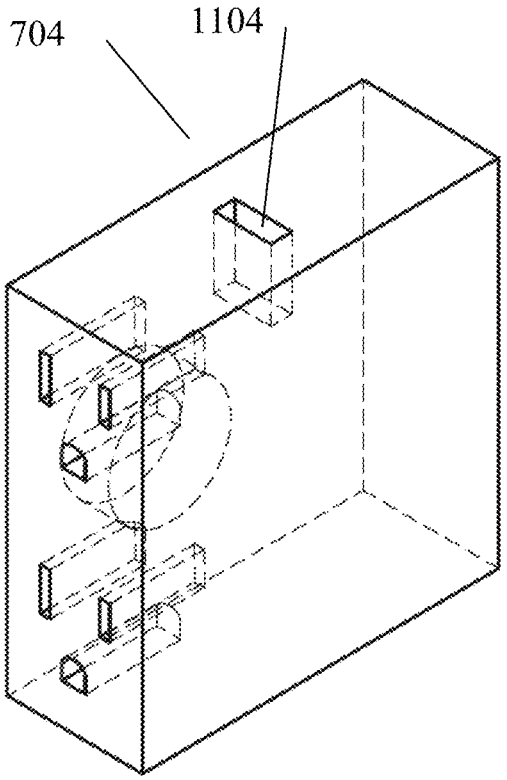
FIG. 11A is a view of a right wing of a modular power supply.
Figure 11B:
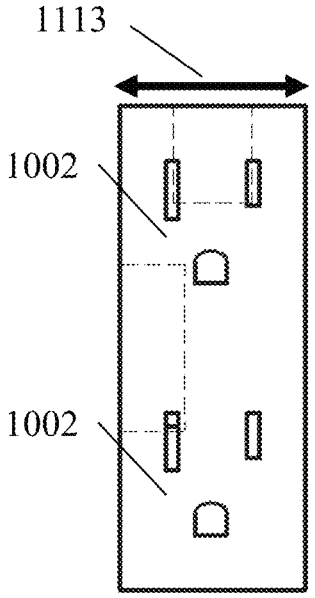
FIG. 11B is a view of a right wing of a modular power supply.
Figure 11C:
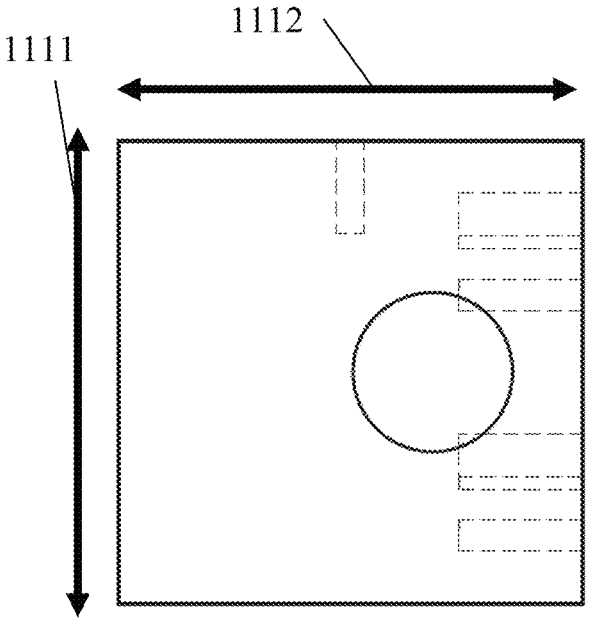
FIG. 11C is a view of a right wing of a modular power supply.
Figure 11D:
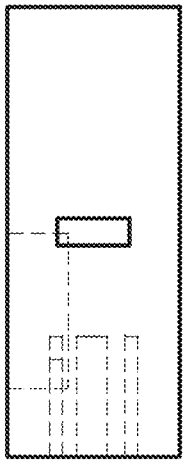
FIG. 11D is a view of a right wing of a modular power supply.
Figure 12A:
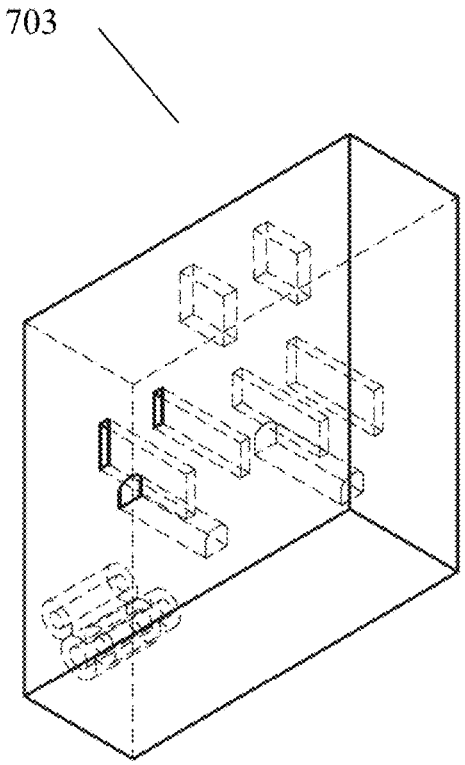
FIG. 12A is a view of a middle block of a modular power supply.
Figure 12B:
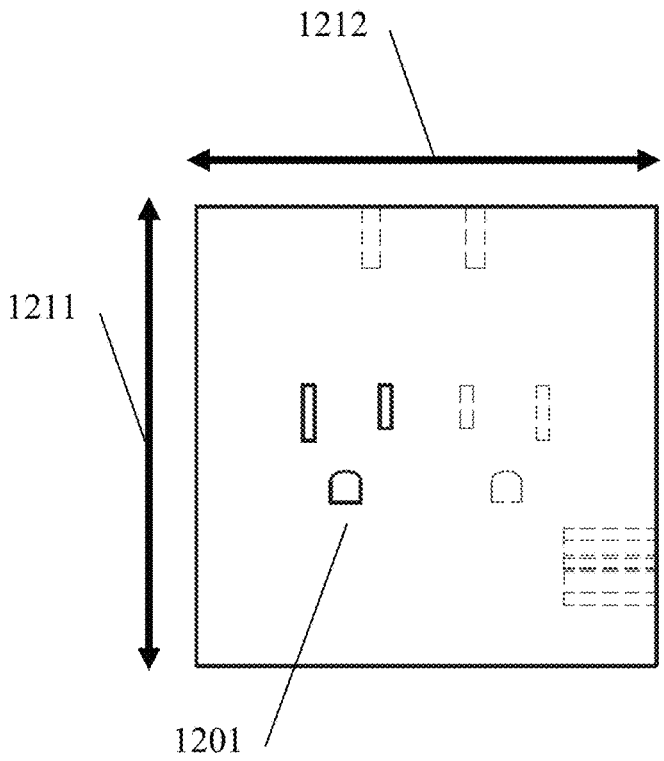
FIG. 12B is a view of a middle block of a modular power supply.
Figure 12C:
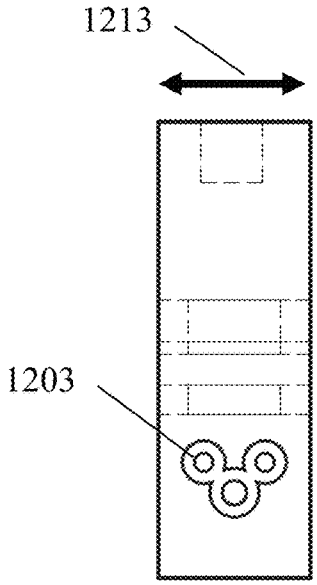
FIG. 12C is a view of a middle block of a modular power supply.
Figure 12D:
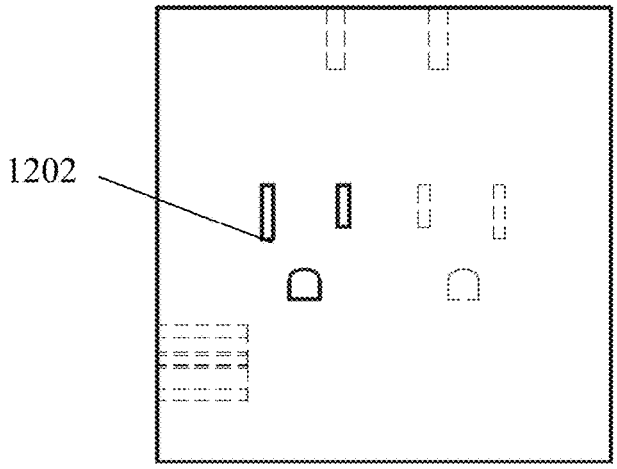
FIG. 12D is a view of a middle block of a modular power supply.

With reference to FIG. 10A. FIG. 10B, FIG. 10C, and FIG. 10D, detail views of left wing 701 are shown. The off-center positioning of the electrical plug connector 702 is evident in the right-side view FIG. 10C and the perspective view FIG. 10A, while the front (FIG. 10B) and top (FIG. 10D) views show exemplary placements for the AC and DC electrical sockets (1002 and 1004, respectively). FIG. 11A, FIG. 11B, FIG. 11C, and FIG. 11D provide corresponding detail views of right wing 704, highlighting the differing placement of the inner face electrical plug connector 702 on the right wing 704.

With reference to FIG. 12A, FIG. 12B, FIG. 12C, and FIG. 12D, detail views of an exemplary middle block 703 are shown. As can be seen in the perspective (FIG. 12A), left (FIG. 12D), and right (FIG. 12B) views, the sockets 1201, 1202 to which the inner face electrical plug connectors 702 of left wing 701 and right wing 704 connect are offset from one another and on opposite outer faces of the middle block 703.

Figure 13A:
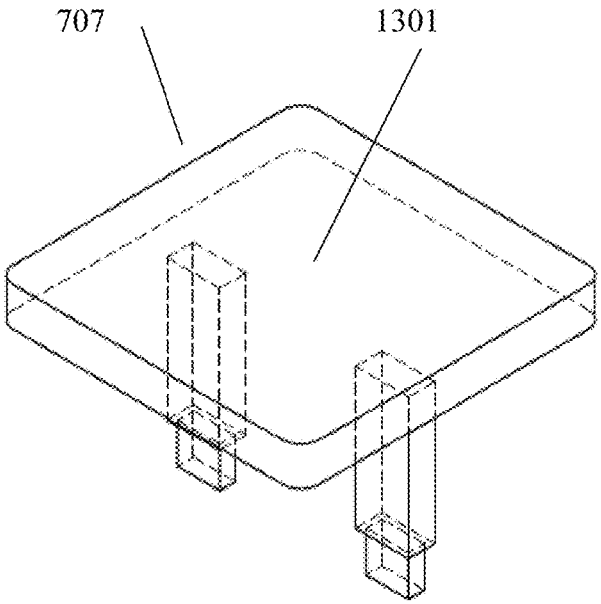
FIG. 13A is a view of a wireless charger of a modular power supply.
Figure 13B:
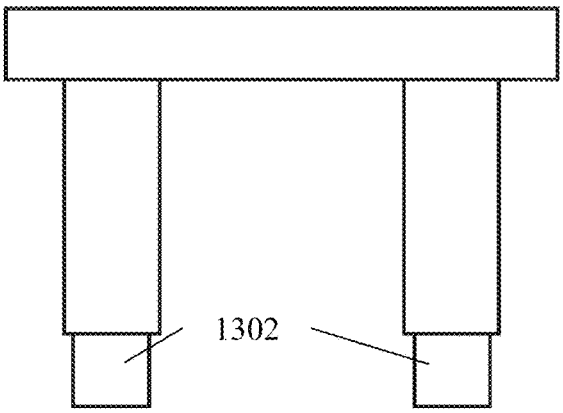
FIG. 13B is a view of a wireless charger of a modular power supply.
Figure 13C:
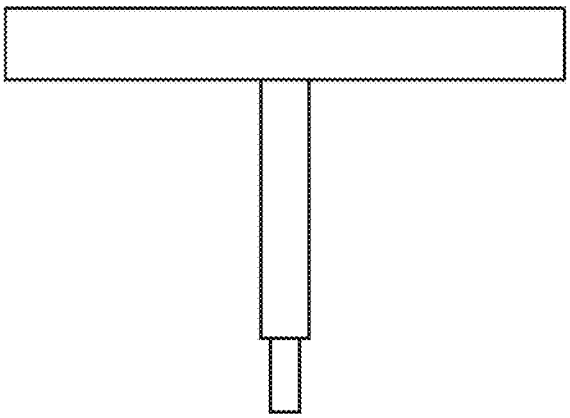
FIG. 13C is a view of a wireless charger of a modular power supply.

With reference to FIG. 13A, FIG. 13B, and FIG. 13C, an exemplary peripheral 707 is shown having two USB-A male connectors 1302 configured to be inserted into USB-A female sockets 1004, 1104 positioned on the top faces of left wing 701 and right wing 704. The depicted peripheral is a wireless charger.

Figure 14A:
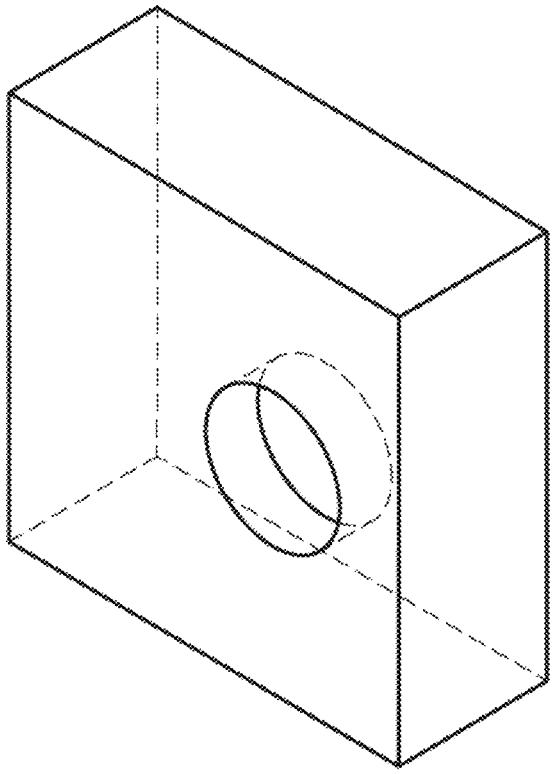
FIG. 14A is a view of a battery pack of a modular power supply.
Figure 14B:
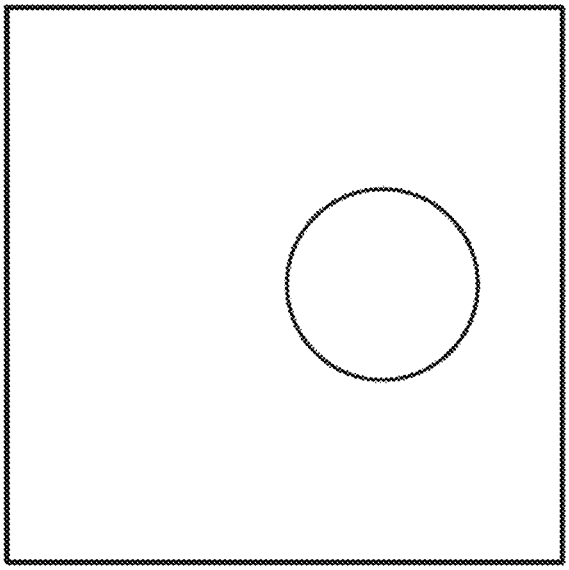
FIG. 14B is a view of a battery pack of a modular power supply.

With reference to FIG. 14A and FIG. 14B, detail views of an exemplary battery for use with a modular power source is shown. The exemplary battery may be reconfigurable either as a right or left side battery, for example by switching which outer face the electrical connector protrudes from.

In one embodiment, a modular power source may comprise a software communication interface connection to, for example, a smartphone app or other software running on a remote computing device. The smartphone app or other software may comprise one or more features related to controlling or monitoring aspects of the modular power source, including but not limited to disconnecting power, for example via one or more relays, from one or more electrical sockets 1002, 1201, 1202 and/or DC power and/or communication ports 1004, 1104 on a face of the modular power source, in response to a button press in a smartphone app. In other embodiments, power may be connected or disconnected from one or more electrical sockets 1002, 1201, 1202 and/or DC power and/or communication ports 1004, 1104 in response to a timer, a temperature measurement above or below a threshold, a word or phrase received by a microphone, a voltage or current measurement, or a combination of these. In some embodiments, a software running on a remote computing device may be configured with a user interface to display system parameters, for example current draw from one or more sockets 1002, 1201, 1202 and/or DC power and/or communication ports 1004, 1104 or the left wing or right wing, temperature measurements, power dissipated over time, ambient light levels, or any other parameters.

With reference to FIG. 15A-FIG. 15F, various exemplary user interface screens of an exemplary smartphone app for interfacing with a modular power source of the present disclosure are shown. The depicted software application comprises various indicators and control elements for monitoring and controlling the modular power source and one or more devices connected to it. In the depicted exemplary embodiment, the modular power source is configured to deliver power to three devices, a television, a game console, and a device connected to a USB port.

Figure 15A:
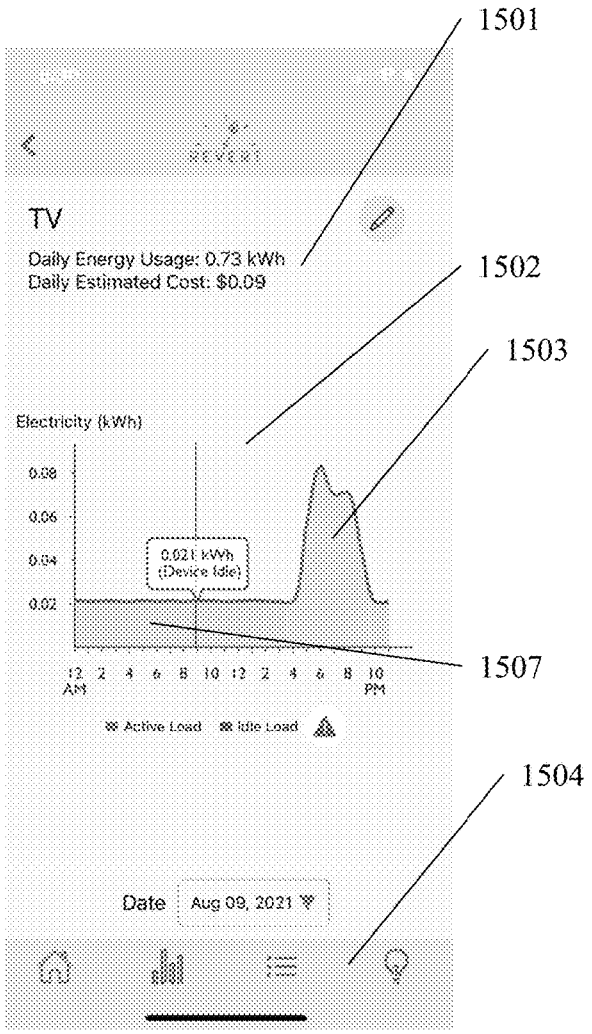
FIG. 15A, FIG. 15B, FIG. 15C, FIG. 15D, FIG. 15E, and FIG. 15F are exemplary user interface screens of a software application for a mobile device.

With reference to FIG. 15A, an exemplary first screen of a user interface is shown. The depicted screen includes a navigation menu 1504 and also various graphs and indicators, including a first counter 1501, which in the depicted embodiment shows the estimated daily energy usage, in kilowatt hours (kWh) and dollars, for the television. The screen further includes a time series graph 1502 which shows the energy usage over time, including a first region

1507 where the device is idle (i.e. plugged in and still drawing standby power even though it is turned off) and a second region where the device is active (i.e. powered on). The depicted graph shows an hour-by-hour view of device energy consumption in kWh. With the depicted graph 1502, it is possible to visualize the power consumption of one or more devices and identify areas for energy and cost savings, for example disconnecting one or more devices from mains electric when they are not in use. In some embodiments, a graph may show an average power use in kW over some time period, for example per hour. In some embodiments, a graph may show a real-time power use in kW over time, sampled at some sampling interval, for example every 30 seconds or every minute. In some embodiments, an algorithm, for example a machine learning algorithm, may be used to determine when a device is in an idle or active state.

Figure 15B:
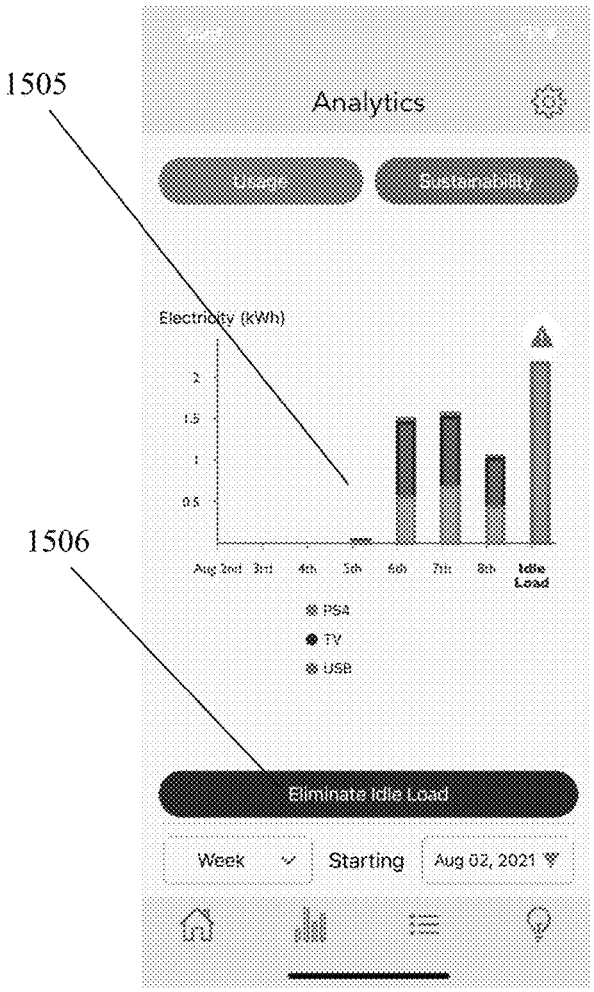

With reference to FIG. 15B, an exemplary second screen of a user interface is shown. The depicted screen includes a bar graph 1505 showing the per-day power consumed in kWh, broken down by device (here the television, game console, and USB port). This bar graph and the graph 1502 in FIG. 15A show an advantage of the current device over existing power strips, because each individual electrical socket in the modular power supply may be independently monitored and controlled, allowing the user to determine how much power is being consumed by each of multiple devices connected to the same modular power supply. Also included in the screen of FIG. 15B is a button 1506 which allows the user to initiate one or more control operations to eliminate idle load, for example using a machine learning algorithm or other software process to determine when one or more devices are predicted to be idle, and disconnecting those devices from mains electric during that time, preventing them from drawing idle current. In some embodiments, an algorithm, for example a machine learning algorithm, may compile user behavior on a regular basis, for example on a daily or weekly basis, and may calculate the total wasted energy and/or idle load.

Figure 15C:
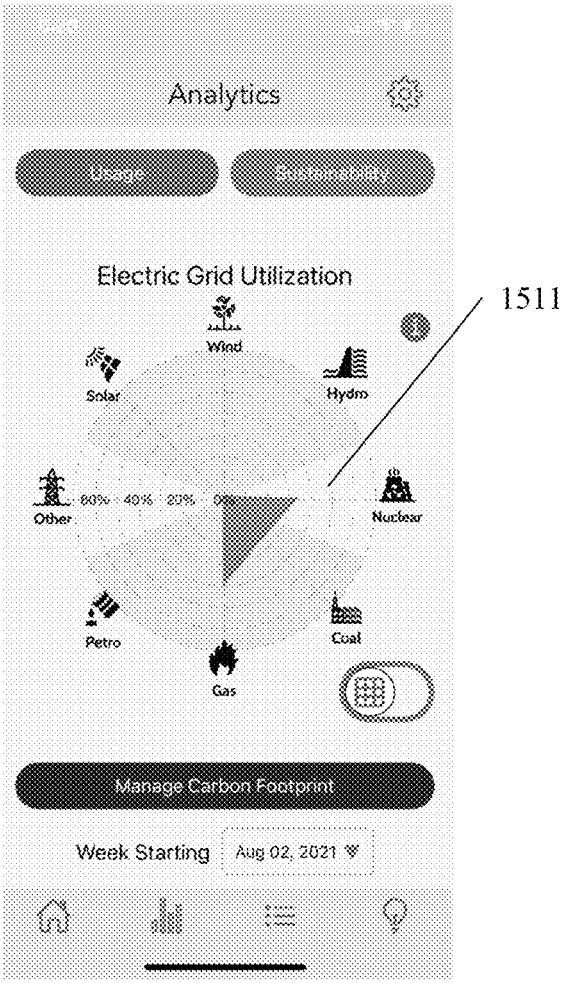

With reference to FIG. 15C, a third screen of a user interface is shown. The third screen incorporates utility information from a given address or municipality, incorporating data from publicly available sources as well as known information about an individual home's electricity supplier, to estimate the carbon footprint of the devices connected to the modular power supply. In some embodiments, the device may be configured to acquire real-time information about the various sources supplying the local grid, for example where more solar energy is being supplied to the grid on sunny days, or more wind energy being supplied to the grid when a local wind farm is operating at a high capacity. In the depicted graph, a mix of nuclear, coal, and natural gas energy is shown.

Figure 15D:
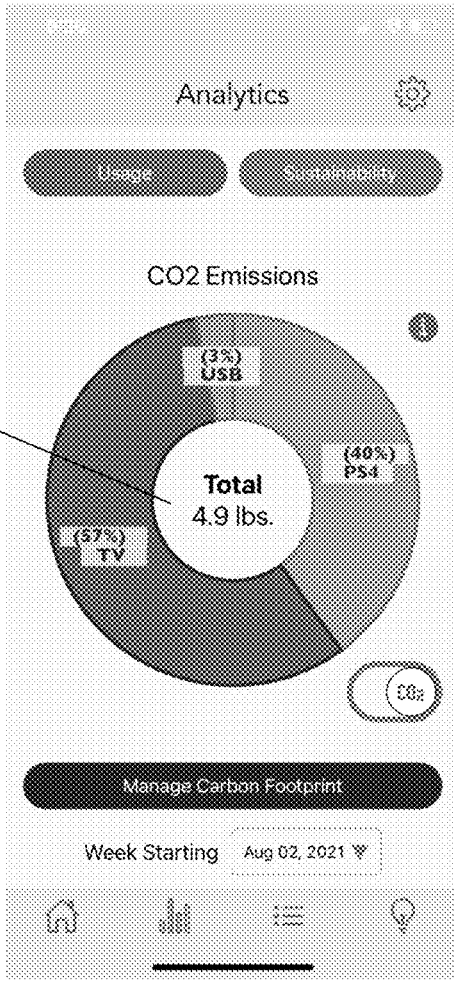

With reference to FIG. 15D, a fourth screen of a user interface is shown. The fourth screen shows a breakdown of $CO_2$ emissions generated by powering the devices connected to the modular power supply. In the depicted pie chart, it is shown that the total carbon emitted to produce the power consumed by the three devices is 4.9 lb., with 57% of that allocated to the television, 40% to the game console, and 3% to the device plugged in to the USB connector.

Figure 15E:
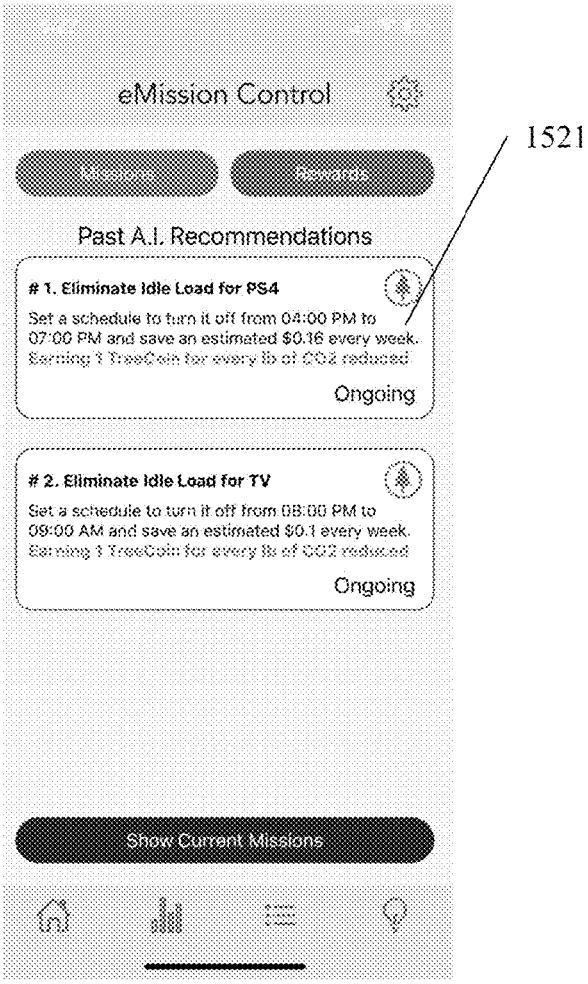
Figure 15F:
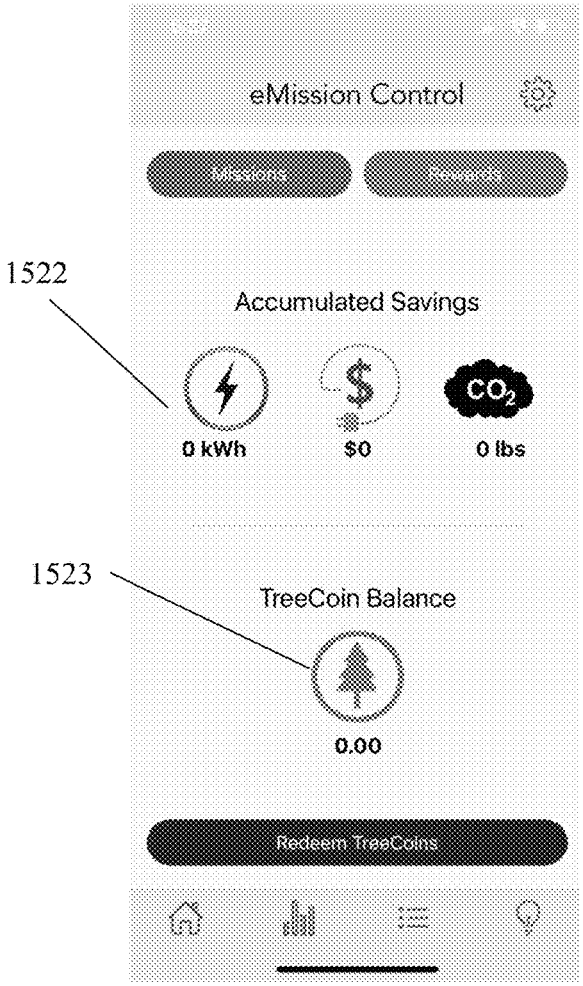

With reference to FIG. 15E and FIG. 15F, two screens of the user interface are shown depicting exemplary gamification elements of an exemplary software application interfacing with the modular power supply. For example, in some embodiments an artificial intelligence or machine learning algorithm may generate recommendations 1521 presented as missions for the user, with the goal of reducing energy use. For example, the first mission presented in FIG. 15E instructs the user to eliminate the idle load for the game console by scheduling the outlet on the modular power supply to which the game console is connected to disconnect from mains electric between 4:00 pm and 7:00 pm each day, a time window which has been algorithmically been determined to correspond with a low or zero probability of use of the game console. The depicted mission is shown as active, and may for example track the total estimated energy savings over time corresponding to the scheduling change. In some embodiments, the user may be compensated with a virtual currency for completing missions and reducing their energy usage. In the depicted embodiment, a "TreeCoin" is used as a unit of virtual currency. In some embodiments, a user interface screen may include an indicator of total accumulated energy savings over time 1522, and/or a balance of the virtual currency 1523.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

What is claimed is:

1. A modular power source, comprising:

a middle block having a housing, comprising a connector for receiving power from a supply of electricity, and at least one electrical socket on a face of the middle block;

at least one wing assembly, comprising:

at least one connector on a face of the wing assembly, the connector configured to form an electrical connection between the wing assembly and the middle block; and at least one controllable electrical socket;

at least one computing device configured to connect or disconnect the at least one controllable electrical socket from the power source; and at least one sensor configured to measure a parameter of the modular power source, the sensor communicatively connected to the at least one computing device;

wherein the at least one wing assembly comprises a cavity, with at least one connector positioned within the cavity;

wherein the middle block comprises a rotating protrusion, the rotating protrusion comprising at least one socket; and wherein the cavity on the wing assembly is configured to receive the rotating protrusion, forming the electrical connection between the at least one connector and the at least one socket.

2. The modular power source of claim 1, further comprising a second wing assembly, wherein the second wing assembly is configured to connect to the at least one electrical socket of the middle block.

3. The modular power source of claim 1, wherein the at least one sensor is selected from the group consisting of a current sensor, a voltage sensor, a temperature sensor, an infrared sensor, an ambient light sensor, and a microphone.

4. The modular power source of claim 1, wherein the at least one computing device is positioned within the at least one wing assembly.

5. The modular power source of claim 1, further comprising at least one DC power/communication port on a surface of the at least one wing assembly.

6. The modular power source of claim 1, wherein the modular power source forms a cube having a length along each side of less than six inches.

7. The modular power source of claim 1, wherein the at least one wing assembly is configured to rotate about an axis with respect to the middle block when electrically connected to the middle block via the electrical connection;

wherein the axis is normal to the inner face of the wing assembly.

8. The modular power source of claim 1, wherein the at least one computing device is communicatively connected to a Wi-Fi transceiver, and the at least one computing device is configured to act as a Wi-Fi range extender.

9. The modular power source of claim 1, wherein the at least one sensor comprises a current sensor configured to measure a power consumption of at least one device electrically connected to the controllable electrical socket.

10. A modular power source, comprising:

a middle block having a housing, comprising a connector for receiving power from a supply of electricity, and at least one electrical socket on a face of the middle block;

at least one wing assembly, comprising:

at least one connector on a face of the wing assembly, the connector configured to form an electrical connection between the wing assembly and the middle block; and at least one controllable electrical socket at least one computing device configured to connect or disconnect the at least one controllable electrical socket from the power source; and at least one sensor configured to measure a parameter of the modular power source, the sensor communicatively connected to the at least one computing device;

a rotating adapter comprising at least one electrical plug connector and at least one socket, the cavity configured to receive the rotating adapter forming an electrical connection between the at least one connector in the cavity and the at least one socket;

wherein the at least one wing assembly comprises a cavity, with at least one connector positioned within the cavity.

11. A modular power source, comprising:

a middle block having a housing, comprising a connector for receiving power from a supply of electricity, and at least one electrical socket on a face of the middle block;

at least first and second wing assemblies, each comprising:

at least one connector on a face of the wing assembly, the connector configured to form an electrical connection between the wing assembly and the middle block; and at least one controllable electrical socket at least one computing device configured to connect or disconnect the at least one controllable electrical socket from the power source; and at least one sensor configured to measure a parameter of the modular power source, the sensor communicatively connected to the at least one computing device;

wherein the first and second wing assemblies each comprise a DC power/communication port on a surface of the first and second wing assemblies.

12. The modular power source of claim 11, further comprising a peripheral having first and second DC power/communication connectors configured to connect to the DC power/communication ports on the surfaces of the first and second wing assembles.

13. The modular power source of claim 12, wherein the peripheral is a wireless charger.

14. The modular power source of claim 12, wherein the DC power/communication ports are USB-A female ports and the DC power/communication connectors are USB-A male connectors.

15. A modular power source, comprising:

a middle block having a housing, comprising a connector for receiving power from a supply of electricity, and at least one electrical socket on a face of the middle block;

at least one wing assembly, comprising:

at least one connector on a face of the wing assembly, the connector configured to form an electrical connection between the wing assembly and the middle block; and at least one controllable electrical socket;

at least one computing device configured to connect or disconnect the at least one controllable electrical socket from the power source; and at least one sensor configured to measure a parameter of the modular power source, the sensor communicatively connected to the at least one computing device;

wherein the middle block further comprises a plurality of magnets positioned within the housing of the middle block; and wherein the at least one wing assembly further comprises a ferromagnetic element configured to be positioned proximate to the plurality of magnets when the middle block is electrically connected to the at least one wing assembly.

16. A modular power source, comprising:

at least one wing assembly, comprising:

at least one wing assembly interface connector on an inner face of the wing assembly; and at least one controllable electrical socket on a front face of the wing assembly; and a middle block comprising:

a connecting face comprising a middle block interface connector configured to removably connect to the at least one wing assembly interface connector;

a rotating element comprising:

an inner portion and an outer portion rotatably connected to the inner portion;

the outer portion configured to be removably connected to the wing assembly; and wherein the inner portion of the rotating element is configured to rotate about an axis with respect to the wing assembly when the outer portion is electrically connected to the wing assembly;

wherein the outer portion of the rotating element comprises a plurality of rotational stops each having a contact point, and the inner portion of the rotating element comprises a plurality of detents configured to receive the plurality of contact points;

wherein the at least one wing assembly is configured to connect to the middle block in a plurality of different orientations.

17. The modular power source of claim 16, the inner portion comprising an annular ring comprising the plurality of detents, the plurality of detents spaced equally apart along the annular ring.

18. The modular power source of claim 16, wherein the plurality of rotational stops comprises four rotational stops and the plurality of detents comprise four detents.

19. The modular power source of claim 16, wherein the plurality of rotational stops are springs configured to be deformed when the plurality of contact points are not positioned in the detents, and restored to normal shape when the plurality of contact points are positioned in the detents.

20. The modular power source of claim 16, wherein the wing assembly interface connector and the middle block interface connectors are electrical socket connectors.

* * * * *